US011472447B2

(12) United States Patent
Kries et al.

(10) Patent No.: US 11,472,447 B2
(45) Date of Patent: Oct. 18, 2022

(54) RAILROAD FREIGHT CAR COUPLING SYSTEM

(71) Applicant: MINER ENTERPRISES, INC., Geneva, IL (US)

(72) Inventors: Andy R. Kries, Elgin, IL (US); Erich A. Schoedl, Sugar Grove, IL (US); Keith A. Salis, Clare, IL (US); Kenneth A. James, West Chicago, IL (US); Richard B. Biehl, St. Charles, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 17/223,868

(22) Filed: Apr. 6, 2021

(65) Prior Publication Data

US 2021/0331721 A1 Oct. 28, 2021

Related U.S. Application Data

(60) Provisional application No. 63/013,666, filed on Apr. 22, 2020.

(51) Int. Cl.
*B61G 5/00* (2006.01)
*B61G 1/36* (2006.01)

(52) U.S. Cl.
CPC ..... *B61G 5/00* (2013.01); *B61G 1/36* (2013.01)

(58) Field of Classification Search
CPC ..... B61G 5/00; B61G 1/36; B61G 9/06
See application file for complete search history.

(56) References Cited

U.S. PATENT DOCUMENTS 8,196,912 B2 * 6/2012 Carlstedt ..... B61G 9/06 267/141.1
8,365,930 B2 * 2/2013 Carlstedt ..... B61G 9/06 213/40 D
8,590,717 B2 * 11/2013 Wilt ..... B61G 9/06 213/40 R (Continued)

FOREIGN PATENT DOCUMENTS

RU 2388634 5/2010

OTHER PUBLICATIONS

International Searching Authority; Written Opinion of the International Searching Authority; 13 pages; dated Jul. 8, 2021.

(Continued)

*Primary Examiner* — Ryan J. Walters
(74) *Attorney, Agent, or Firm* — Law Office of John W. Harbst

(57) ABSTRACT

A railroad freight car coupling system utilizing purely mechanical cushioning assemblies at opposed ends of the car. Each cushioning assembly includes an elongated draft gear assembly including two individually operable and axially spaced assemblies for absorbing both buff and draft forces. Each draft gear assembly includes an axially elongated and hollow metal housing with a first open end and a second open end disposed in longitudinally spaced relation relative to each other. The draft gear assembly is provided with first and second spring biased assemblies at opposed open ends of the housing for absorbing, storing and returning energy directed against a railroad freight car with which the draft gear assembly is arranged in operable combination.

24 Claims, 20 Drawing Sheets

(56) References Cited

U.S. PATENT DOCUMENTS

| | | | | |
|---|---|---|---|---|
| 8,870,002 | B2 * | 10/2014 | Wilt | B61G 9/12 213/40 R |
| 8,939,300 | B2 * | 1/2015 | Wilt | B61G 9/06 213/31 |
| 8,985,355 | B2 * | 3/2015 | Wilt | B61G 9/06 213/45 |
| 9,789,888 | B2 * | 10/2017 | Wilt | B61G 9/14 |
| 10,328,957 | B2 * | 6/2019 | Wilt | B61G 9/14 |
| 2002/0108920 | A1 | 8/2002 | Carlstedt | |
| 2008/0290058 | A1 | 11/2008 | Palermo et al. | |
| 2013/0153526 | A1 | 6/2013 | Will et al. | |
| 2016/0052530 | A1 | 2/2016 | Wilt et al. | |

OTHER PUBLICATIONS

International Searching Authority; PCT International Search Report; 2 pages; dated Jul. 8, 2021.

* cited by examiner

RAILROAD FREIGHT CAR COUPLING SYSTEM

RELATED APPLICATION

This patent application relates to a co-pending and co-assigned U.S. PROVISIONAL patent application, namely, U.S. patent application Ser. No. 63/013,666 filed Apr. 22, 2020; the entirety of which is incorporated herein by reference.

FIELD OF THE INVENTION DISCLOSURE

This invention disclosure generally relates to railroad freight cars and, more specifically, to a railroad freight car coupling system including two individually operable and axially spaced assemblies for absorbing both buff and draft forces normally encountered by railroad freight cars during their in-service operation.

BACKGROUND

When a train consist is assembled in a rail yard, railcars run into and collide with each other to couple them to each other. Since "time is money", the speed at which the railcars are coupled has significantly increased. Moreover, and because of their increased capacity, railroad freight cars are heavier than before. These two factors and others have resulted in increased damages to the railcars when they collide with each other and, frequently, the lading carried with such railcars.

As railroad car designers/builders continue in their efforts at reducing the weight of railcar designs, they have also identified a need and desire to protect the integrity of the railcar due to the excessive longitudinal loads/forces being placed thereon, especially as the railcars are coupled to each other. Whereas, such longitudinal loads/forces on the cars frequently exceed the design load limits set by the Association of American Railroads ("AAR").

Providing an energy absorption system at opposed ends of each railcar has been long known in the art. In some applications, the energy absorption system at opposed ends of the car is captured within a defined space provided between front and rear pairs of stops arranged in operable combination with a centersill at each end of the railcar. Also, and once installed into operable combination with a railcar, the energy absorption system at opposed ends of the railcar is expected to yield energy absorption capabilities for the railcar over an extended period of time which, depending upon the level of service wherein the railcar is employed, can last for many years if not decades. Such energy absorption systems can typically be classified into multiple groups. In one form, an energy absorption system can include a type of hydraulic dampener for reducing the energy directed against the railcar. Another form of energy absorption system uses steel springs for reducing the energy directed against the railcar. Yet another form of energy absorption system utilizes a series of axially stacked elastomeric pads for absorbing and dampening the energy directed against the railcar. Still another type or form of energy absorption system utilizes a friction clutch assembly arranged at one end of a draft gear in operable combination with axially stacked elastomeric pads for absorbing and dampening the energy directed against the railcar.

The impacts occurring during the "make-up" of a train consist and during in-service train action subject the energy absorption system at opposed ends of the railcar to repeated buff impacts. In-service action also subjects the energy absorption system at opposed ends of the railcar to both repeated buff and draft events. The impacts associated with these events are transmitted from the railcar couplers to the respective energy absorbing system or cushioning assembly and, ultimately, to the railcar body. That is, as the railcar couplers are pushed and pulled in opposite longitudinal directions be it during in-service action and/or during the "make-up" of the train consist, such movements although muted by some degree by the cushioning assembly, are translated to the railcar body.

While use of a cushioning assembly in the form of a hydraulic dampener at opposed ends of the railcar offers certain advantages, such a cushioning assembly, however, is not without problems. Keeping in mind the service life of a railcar cushioning assembly can extend over several decades, repeated longitudinal translations and reciprocations of an extended rod or member forming an essential part of the hydraulic dampener quickly can adversely wear on and, ultimately, destroy sealing structure inherent with such a hydraulic dampener resulting in fluid loss whereby minimizing its ability to provide railcar protection. Moreover, known hydraulic devices may cause unintended brake hose uncoupling events that can cause train stoppages.

As mentioned, cushioning assemblies utilizing an axial stack of elastomeric pads to cushion the energy directed against the railcar are also known. Advantageously, and besides the benefits of cushioning the energy directed against the railcar, a cushioning assembly utilizing an axial stack of elastomeric pads furthermore yields the benefit of having at least a portion of the energy directed against the railcar being absorbed by the elastomeric pads. Unfortunately, and largely because of the both buff and draft directional forces being repeatedly applied to the cushioning assembly, such cushioning assemblies, especially when used in combination with today's railcars whereupon higher energy is being directed against them, have a lesser degree of effectiveness to impact forces.

Because of the relatively high energy environment wherein such cushioning units are being used, a cushioning assembly which utilizes a friction clutch assembly arranged at one end of the cushioning assembly and in operable combination with axially stacked elastomeric pads has proven very beneficial. These cushioning assemblies having a friction clutch arranged in operable combination therewith have been known to advantageously absorb high levels of energy imparted thereto. In some applications, such cushioning assemblies have advantageously been used in a tandem arrangement relative to each other to increase the level of energy which can be cushioned by such an arrangement.

These Applicants recognized and realized how particularly beneficial it could be if a purely mechanical energy absorption system could be used to replace the heretofore known cushioning devices utilizing hydraulics. That is, a purely mechanical energy absorption system could beneficially be used to cushion the impact forces directed at opposite ends of a railcar typically using a version of a hydraulic system while advantageously eliminating the leakage problems known with such hydraulic systems.

Unfortunately, the longitudinal distance separating the front and rear pairs of stops on the centersill normally associated with a hydraulic cushioning assembly complicates simply switching a purely mechanical cushioning assembly for a hydraulic cushioning assembly. Applicants have found the elongated space between the front and rear pairs of stops associated with a railcar which utilizes a cushioning assembly with a hydraulic unit demands use of two draft gear assemblies to fill the longitudinal space between the stops. Of course, and besides the increased costs associated with having such a duplicative design utilizing two draft gear assemblies, such proposal furthermore requires a follower to be disposed between the two back-to-hack draft gear assemblies. For these and other reasons, simply replacing a cushioning assembly which utilizes hydraulics with a mechanical system is far more complicated that it may initially appear.

It is also known to arrange a yoke in combination with the cushioning assembly. Typically, the yoke includes a back wall interconnected to top and bottom walls extending generally parallel to each other and toward an open end of the yoke. The cushioning assembly is typically sandwiched between the top and bottom walls of the yoke with a follower disposed toward a forward end of the cushioning assembly. The forward open end of the yoke is operably coupled to a railcar coupler which axially extends away from the cushioning assembly at each end of the railcar so as to allow adjacent railcars to be coupled to each other. Toward the open end thereof, the yoke is articulately connected to the railcar coupler through a suitable pin or key.

In buff events, a rear or butt end of a shank portion on the coupler moves axially inward and presses against a follower thus pushing the follower and cushioning assembly toward the pair of rear stops on the centersill. As the coupler and follower move under the influence of a buff event, a portion of the load or impact event is absorbed and dissipated by the cushioning assembly.

In draft events, unavoidable slack between adjacent but coupled railcars is taken up beginning at a starting or locomotive end of the train consist and ending at the other end of the train consist. As a result of the slack being progressively taken up, the speed difference between the railcars increases as the slack inherent with each railcar coupling at each end of the railcar in the train consist is taken up, with the resultant increase in draft events on the cushioning system. For example, when a locomotive on a train consist of railcars initially begins to move from a stopped or at rest position, there may be 100 inches of slack between the 50 or so pairs of couplings. This slack is taken up progressively by each pair of joined railcar couplings in the train consist. After the slack of the railcar coupling joining the last railcar to the remainder of the train consist is taken up, the next to the last railcar may be moving a few miles per hour. Given the above, it will be appreciated, the slack in the railcar couplers near the locomotive is taken up very rapidly while those railcars further from the locomotive are subject to very high energy events being placed thereon. Such large energy events are capable of damaging both the railcar structures and sometimes the lading in the railcar.

Thus, there is a need and continuing desire for a mechanical railroad freight car coupling system for absorbing both buff and draft forces normally encountered by railroad freight cars during their in-service operation and which has sufficient capacity and capabilities to replace heretofore known hydraulic dampeners at opposed ends of the railcar.

SUMMARY

In view of the above, these inventors are the first to design and develop a purely mechanical railroad freight car coupling system which is simplistic in design while advantageously utilizing an elongated draft gear design including a hollow housing with two individually operable and axially spaced assemblies arranged at opposite ends of the housing for absorbing both buff and draft forces. The preferable elongated and single housing design of this invention disclosure significantly reduces material costs associated with this railroad freight car coupling system. Fewer parts and less material readily translates into reduced costs while maintaining higher performance over an extended travel in both draft and buff directions.

In accordance with one aspect of this invention disclosure, there is provided a draft gear assembly for absorbing, storing and returning energy directed against a railroad freight car, with the draft gear assembly being arranged in operable combination therewith. The railcar with which this invention finds utility has a centersill defining a pocket with a distance of about 38 inches to about 50 inches between front and rear stops. According to this aspect, the draft gear assembly has an axially elongated and hollow metal housing with a first open end and a second open end disposed in longitudinally spaced relation relative to each other. The housing is configured to fit within the pocket defined by the centersill on the railcar. In one embodiment, each end of the housing defines a series of longitudinally tapered and extended inner surfaces opening to and extending from each open end of the housing. In a preferred embodiment, the elongated housing has a unitary one-piece design.

In one embodiment, a first assembly and a second assembly are arranged in operable combination with the respective open end of the housing. In this embodiment, each assembly of the draft gear assembly is configured as a friction clutch assembly and includes a series of friction members equally spaced about a longitudinal axis of and extending toward a longitudinal center of the housing. Each friction member has axially spaced first and second ends and an outer surface extending between the ends. The outer surface on each friction member is operably engaged and associated with one of the longitudinally tapered and extended inner surfaces on the housing so as to define a first angled friction sliding surface therebetween for each clutch assembly. Each friction clutch assembly also includes a wedge operably held within an open end of the housing. The wedge of each friction clutch assembly is arranged for reciprocal movements relative to and has a free end extending beyond the respective open end of the housing so as to allow both buff and draft forces to be applied thereto during in-service operation of the railcar.

The wedge of each friction clutch assembly further defines a series of outer tapered surfaces equally spaced about the longitudinal axis of the housing. Each tapered outer surface on each wedge is operably engaged and associated with an inner surface on each friction member so as to define a second angled friction sliding surface therebetween and such that the axial movements of the wedge of each assembly moving inward relative to the respective open end of the housing causes the respective friction members to move longitudinally and radially inward relative to the respective open end of the housing. In one embodiment, the first and second friction clutch assemblies each include a follower arranged within the housing. One surface of the follower is arranged in operable engagement with the second end of each friction member of the respective clutch assembly.

An axially elongated spring assembly is disposed in the elongated housing between the first and second friction clutch assemblies, disposed at opposed ends of the housing, for storing, dissipating and returning energy imparted to the draft gear assembly. The spring assembly includes an axial stack of multiple individual springs. Preferably, the spring assembly includes an axial stack of ten or more springs.

Each spring preferably includes an elastomeric pad. Moreover, the pads of the spring assembly are preferably guided within the draft gear housing to inhibit buckling of the spring assembly. In operation of the draft gear assembly, the spring assembly functions in operable combination with the disposition of the first and second angled sliding surfaces of each friction clutch assembly to consistently and repeatedly absorb energy imparted to the draft gear over a combined range of travel of the wedge of each friction clutch assembly in an inward axial direction relative to the housing over the full range of travel of each friction clutch assembly at opposite ends of the draft gear assembly from full extension to full compression.

Preferably, the first and second angled friction sliding surfaces of the first and second friction clutch assemblies are substantially identical relative to each other. In another embodiment, the first angled friction sliding surface on the first friction clutch assembly is different from the first angled friction sliding surface on the second friction clutch assembly. In still another embodiment, the second angled friction sliding surface on the first friction clutch assembly is different from the second angled friction sliding surface on the second friction clutch assembly.

In one form, each elastomeric pad used in combination with the multitude of springs comprising each spring assembly has a toroidal outer configuration. Preferably, each elastomeric pad of the multitude of springs comprising each spring assembly has a Shore D hardness ranging between about 40 and about 60. In one embodiment, each elastomeric pad of the multitude of springs comprising each spring assembly has a similar hardness. In another embodiment, a plurality of elastomeric pads of the multitude of springs comprising the elongated spring assembly disposed closest to the first clutch assembly have a different elastomeric hardness as compared to those elastomeric pads of the multitude of springs comprising the elongated spring assembly which are disposed toward a middle of the elongated spring assembly. In still another embodiment, each elastomeric pad can have a composite construction including two different elastomeric materials each having a different Shore D hardness.

In accordance with another aspect of this invention disclosure, a draft gear assembly is adapted to be accommodated in a pocket defined by a railroad freight car centersill. The centersill has front and rear stops with a distance of about 38 inches to about 50 inches longitudinally separating the stops. In accordance with this aspect of the invention disclosure the draft gear assembly includes an axially elongated and hollow metal housing configured to fit between the stops and defining first and second longitudinally spaced open ends. Each end of the housing defining a series of longitudinally tapered and extended inner surfaces opening to and extending from each open end of the housing. In a preferred embodiment, the elongated housing is of unitary construction.

A first friction clutch assembly is arranged in operable combination with the first open end of the housing and a second friction clutch assembly is arranged in operable combination with the second open end of the housing. Each friction clutch assembly includes a series of friction members equally spaced about a longitudinal axis of and extending toward a longitudinal center of the housing. Each friction member has axially spaced first and second ends and an outer surface extending between the ends. The outer surface on each friction member is operably engaged and associated with one of the longitudinally tapered and extended inner surfaces on the housing so as to define a first angled friction sliding surface therebetween for each clutch assembly. Each friction clutch assembly also includes a wedge arranged for axial movements relative to and having a free end extending beyond the respective open end of the housing and to which an external force is applied during operation of the railroad freight car.

The wedge of each friction clutch assembly defines a series of outer tapered surfaces equally spaced about the longitudinal axis of the wedge. Each tapered outer surface on each wedge is operably engaged and associated with an inner surface on each friction member so as to define a second angled friction sliding surface therebetween for each clutch assembly and such that the wedge of each friction clutch assembly causes the respective friction members to move longitudinally and radially inward relative to the respective open end of the housing upon movement of the wedge inwardly of the housing. Each friction clutch assembly further including a follower arranged within the housing. One surface of the follower is arranged in operable engagement with the second end of each friction member of the respective clutch assembly.

According to this aspect of the invention disclosure, an elongated spring assembly is disposed in the housing between the first and second friction clutch assemblies for storing, dissipating and returning energy imparted to the draft gear assembly. The spring assembly includes an axial stack of springs. In one form, the spring assembly includes at least ten or more individual springs which are axially guided with the housing. The spring assembly is configured to function in operable combination with the disposition of the first and second angled sliding surfaces of each friction clutch assembly such that the draft gear assembly consistently and repeatedly absorbs energy imparted to the draft gear assembly over a combined range of travel of the wedge members of the friction clutch assemblies in an inward axial direction relative to the housing ranging between about 6.25 inches and about 9.5 inches, That is, with the present invention disclosure, the wedge member of each friction clutch assembly preferably moves inward between about 3.25 inches and about 4.75 inches relative to the housing during operation of the draft gear assembly. In one form, a separator plate forms part of the spring assembly and is disposed proximately mid-length of the spring assembly between two adjacent individual springs of the spring assembly.

In one form, the first and second angled friction sliding surfaces of the first and second clutch assemblies are substantially identical relative to each other. In another form, the first angled friction sliding surface on the first clutch assembly is different from the first angled friction sliding surface on the second clutch assembly. In another embodiment, the second angled friction sliding surface on the first clutch assembly is different from the second angled friction sliding surface on the second clutch assembly.

Preferably, each elastomeric pad of the multitude of springs comprising each spring assembly has a toroidal outer configuration. In one form, each elastomeric pad of the multitude of springs comprising each spring assembly has a Shore D hardness ranging between about 40 and about 60. In a preferred embodiment, each elastomeric pad of the multitude of springs comprising each spring assembly has a similar hardness. In yet another embodiment, a plurality of elastomeric pads of the multitude of springs comprising the elongated spring assembly disposed closest to the follower of the respective clutch assembly have a different elastomeric hardness as compared to those elastomeric pads of the multitude of springs comprising the elongated spring assembly which are disposed toward a middle of the spring assembly.

According to another aspect of this invention disclosure, there is provided an energy absorption system for a railroad freight car having a centersill defining a pocket having front and rear stops, with a longitudinal distance of about 38 inches to about 50 inches longitudinally separating the stops. A coupler has a head portion longitudinally extending beyond a free end of the centersill and a shank portion connected to and extending from the head portion.

According to this aspect of the invention disclosure, the energy absorption system further includes a draft gear assembly including an axially elongated and hollow metal housing defining first and second longitudinally spaced open ends. At least the first open end of the housing defines a series of longitudinally tapered and extended inner surfaces opening to and extending from the open end of the housing toward a longitudinal center of the housing. A friction clutch assembly is arranged in operable combination with the first open end of the housing. The friction clutch assembly includes a series of friction members equally spaced about a longitudinal axis of and extending toward the longitudinal center of the housing. Each friction member has axially spaced first and second ends and an outer surface extending between the ends. The outer surface on each friction member is operably engaged and associated with one of the longitudinally tapered and extended inner surfaces on the housing so as to define a first angled friction sliding surface therebetween for the clutch assembly.

In this embodiment, the friction clutch assembly also includes a wedge arranged for axial movements relative to and having a free end extending beyond the first open end of the housing and to which an external force is applied during operation of the railroad freight car. The wedge of the friction clutch assembly defines a series of outer tapered surfaces equally spaced about the longitudinal axis thereof. Each tapered outer surface on the wedge is operably engaged and associated with an inner surface on each friction member so as to define a second angled friction sliding surface therebetween for the clutch assembly and such that the wedge of the friction clutch assembly causes the respective friction members to move longitudinally and radially inward relative to the open end of the housing upon inward movement of the wedge. The friction clutch assembly further includes a follower arranged within the housing. One surface on the follower is arranged in operable engagement with the second end of each friction member of the clutch assembly.

A spring assembly is disposed within and between the first and second ends of housing for storing, dissipating and returning energy imparted to the draft gear assembly. The spring assembly includes an axial stack of individual springs. In a preferred form, at least ten individual springs are used in combination relative to each other. The spring assembly is preferably configured to promote axial guidance of the spring assembly within the housing.

At the opposite or second open end of the housing, a member is arranged for limited reciprocating axial movements within and relative to the second open end of the housing. The member at the second end of the housing is biased outwardly of the housing by the spring assembly. Such member at the second end of the housing has a free end extending beyond the second open end of the housing and to which an external force is applied during operation of the railroad freight car.

The spring assembly is configured to function in operable combination with the disposition of the first and second angled sliding surfaces of the first friction clutch assembly and the member disposed at the second end of the housing such that the draft gear assembly consistently and repeatedly absorbs energy imparted to the draft gear assembly over a combined range of travel ranging between about 6.25 inches and about 9.5 inches.

According to this aspect of the invention disclosure, the energy absorption system further includes a yoke having a back wall with top and bottom walls extending therefrom. The shank portion of the coupler is operably connected toward a forward and open end of the yoke while the back wall of the yoke is adapted to operably engage the draft gear assembly when the railroad freight car is operated in draft.

Preferably, the housing of the draft gear assembly has a generally cylindrical cross-sectional configuration extending for a majority of the distance between the first and second open ends thereof. In a preferred embodiment, the elongated housing of the draft gear assembly is of unitary construction.

DETAILED DESCRIPTION

Figure 1:
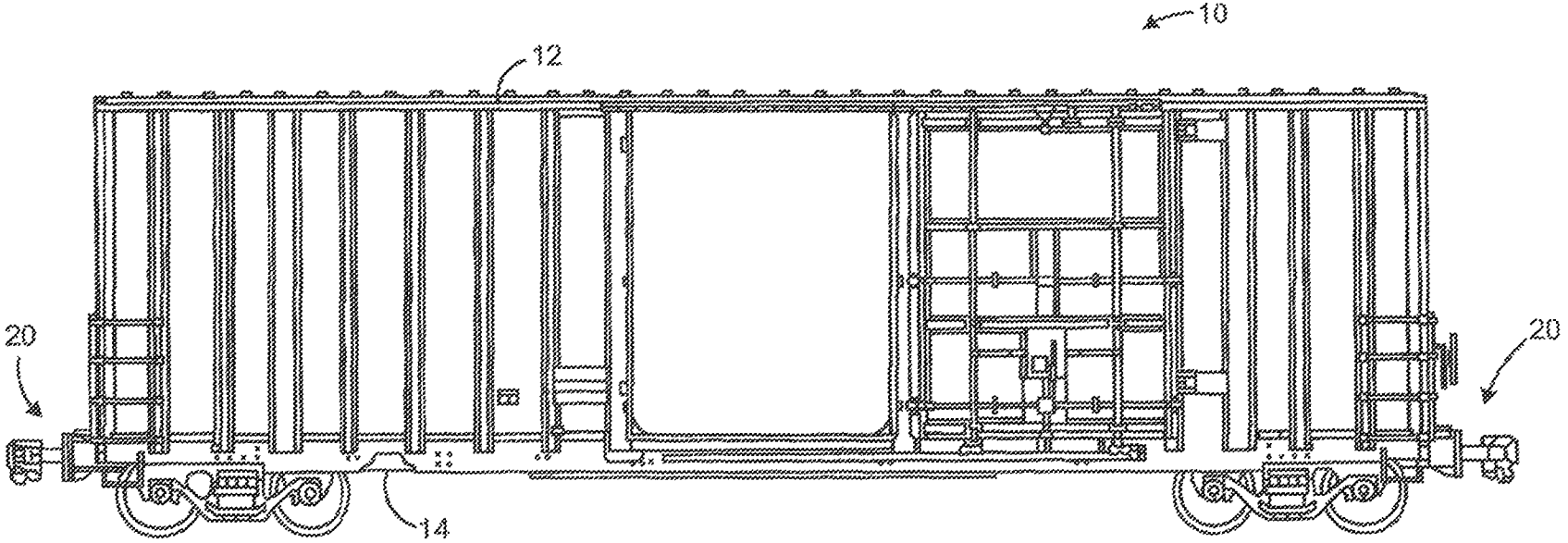
FIG. 1 is a side view of a railroad car embodying principals and teachings of the present invention disclosure.

While this invention disclosure is susceptible of embodiment in various forms, there is shown in the drawings and will hereinafter be described preferred embodiments, with the understanding the present invention disclosure is to be considered as setting forth exemplifications of the disclosure which are not intended to limit the invention disclosure to the specific embodiments illustrated and described.

Figure 2:
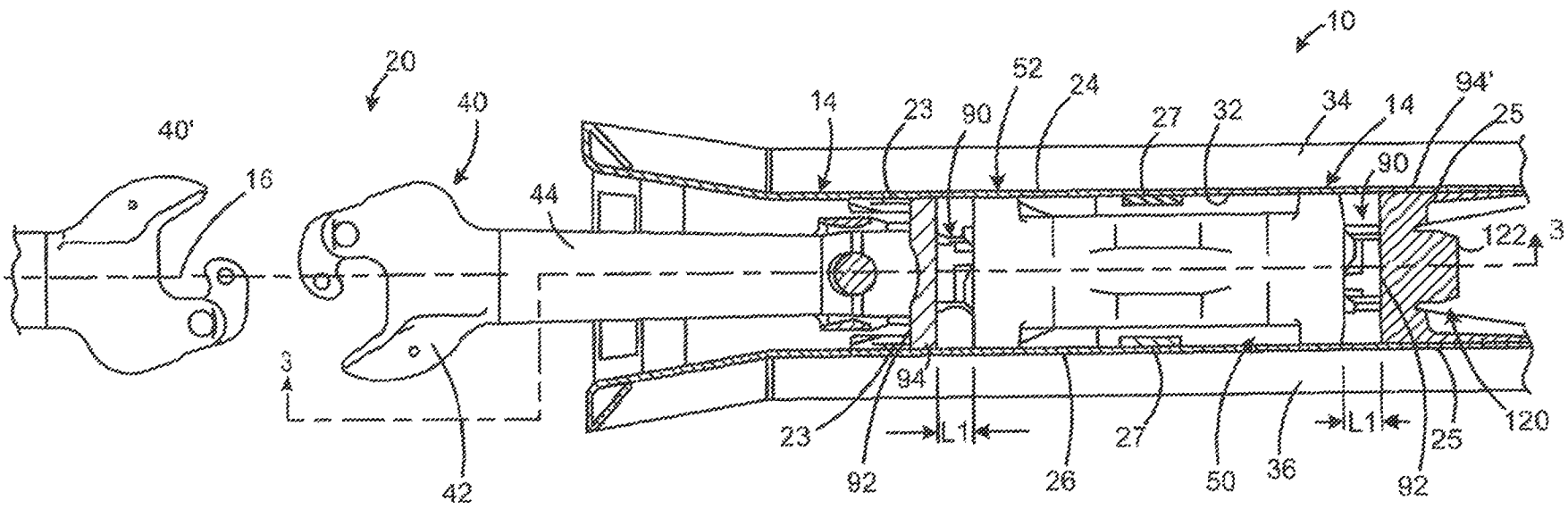
FIG. 2 is an enlarged fragmentary longitudinal sectional view of one embodiment of a railroad car coupling system shown in a neutral position or condition and embodying principals and teachings of the present invention disclosure.

Referring now to the drawings, wherein like reference numerals indicate like parts throughout the several views, there is shown in FIG. 1 a railroad freight car, generally indicated by reference numeral 10. Although a railroad freight car is illustrated for exemplary purposes in FIG. 1, it will be appreciated the teachings and principals of this invention disclosure relate to a wide variety of railcars including, but not limited to, railroad freight cars, boxcars, centerbeam cars, and etc. Suffice it to say, railcar 10 has a railcar body 12, in whatever form, supported on an axially elongated draft sill or centersill 14 defining a longitudinal axis 16 (FIG. 2). In the illustrated embodiment, the centersill 14 is designed as a throughsill and extends the length of the railcar 10. It should be appreciated, however, by those skilled in the art, the centersill 14 could take the form of a stub sill disposed toward opposite ends of car 10 without detracting or departing from the broad spirit and scope of this invention disclosure.

As shown in FIG. 1, a coupling system, generally identified by reference numeral 120, is provided toward opposite ends of the railcar 10 so as to allow adjacent railcars to be coupled to each other. In a preferred embodiment, each coupling system 20 provided toward opposite ends of car 10 are substantially identical relative to each other and, thus, both are identified by reference numeral 20.

The draft sill or centersill 14 shown by way of example in FIG. 2 can be cast or fabricated and has standard features. In one embodiment, and toward each end thereof, (with only one end being shown for illustrative purposes in FIG. 2) the centersill 14 has a first or front pair of laterally spaced stops 23 and a pair of second or rear pair of laterally spaced stops 25 connected to laterally spaced walls 24 and 26 of the centersill 14 (FIG. 2). The front and rear pairs of stops 23 and 25, respectively, are spaced apart from each other by a longitudinal distance suitable for accommodating a conventional and well known hydraulically operated cushioning assembly therebetween. That is, the front and rear pairs of stops 23 and 25, respectively, are spaced apart from each other by a longitudinal distance ranging between about 38 inches and about 50 inches.

In a preferred embodiment, the front and rear pairs of stops 23 and 25, respectively, extend the full height of the draft sill or centersill 14. In the illustrated embodiment, and as is required when a hydraulically operated cushioning assembly is used to absorb energy incurred during in-service operations, a pair of vertically disposed middle or center stops 27 are arranged in operable combination with the centersill 14. Typically, the middle stops 27 are arranged on and in combination with the centersill 14 proximately mid-length between the front and rear pairs of stops 23 and 25, respectively.

Figure 3:
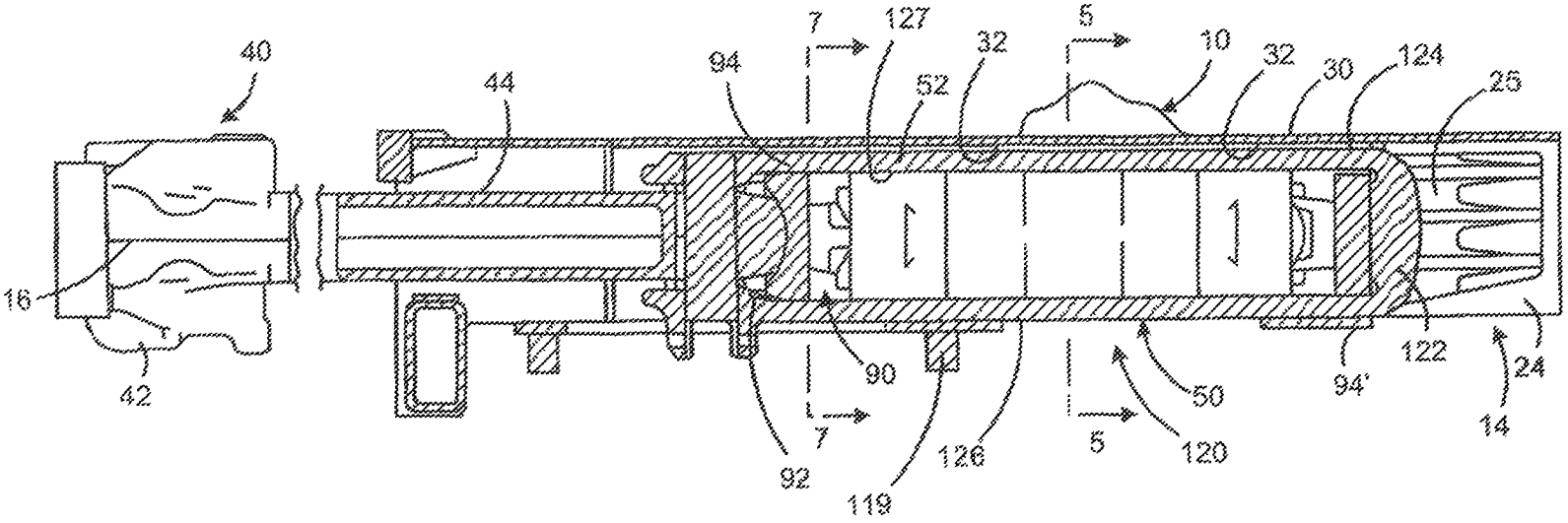
FIG. 3 is a sectional view taken along line 3-3 of FIG. 2.

In the embodiment illustrated by way of example in FIG. 3, the centersill 14 typically has a top wall 30, although it will be appreciated the present invention disclosure is equally applicable to and can be used with a draft sill or centersill lacking such a top wall. Known centersills also include the laterally spaced depending side walls 24 and 26 (FIG. 2). Toward their lower free end, each side wall 24 and 26 of centersill 14 includes a flange 34 and 36, respectively, (FIG. 2) extending outwardly from the longitudinal axis 16 of car 10. As known, the stops 23, 25 and 27 are all secured to interior surfaces of the side walls 24 and 26 of the centersill 14. The centersill 14 can include other standard features and can be made of standard materials in standard ways. As shown in FIG. 2, the front and rear pairs of stops 23 and 25, respectively, combine to define a longitudinally elongated pocket 32 therebetween. It should be understood, the coupling system of this invention disclosure can advantageously be used in operable combination with a variety of different draft sills or centersills 14.

In the embodiment illustrated in FIGS. 2 and 3, each coupling system of this invention disclosure includes a standard coupler, generally identified by reference numeral 40, and an energy management or cushioning assembly, generally indicated by reference numeral 50, arranged in longitudinally disposed and operable combination with the coupler 40. The standard coupler 40 includes a head portion 42 and shank portion 44, preferably formed as a one-piece casting. As is typical, the coupler head portion 42 extends longitudinally outward from the centersill 14 to engage a similar coupler 40' (FIG. 2) extending from an end of a second and adjacent railcar (not shown) to be releasably coupled or otherwise connected to car 10 (FIG. 1). In operation, the shank portion 44 is guided for generally longitudinal movements by the centersill 14 of the railcar 10.

The energy absorption system 50 of the present invention disclosure includes a purely mechanical design having demonstrated the capability of heretofore known hydraulic dampeners with lesser concerns over maintenance. To facilitate use and assembly thereof to other components of the railcar 10, the essence of system 50 involves one draft gear assembly 52 including first and second independent operable assemblies disposed at opposed ends of the energy absorption system 50. In the embodiment illustrated by way of example in FIG. 4, the draft gear assembly 52 includes an axially elongated metallic and hollow housing 60 defining a longitudinal axis 62. Unlike other draft gear designs, housing 60 defines a first open end 64 and a second open end 66 disposed in longitudinally spaced axial relation relative to each other. The unitary cushioning assembly or energy absorption system 50 of the present invention disclosure is specifically configured and designed to fit within the pocket 32 (FIGS. 2 and 3) defined by the centersill 14 on car 10. In a preferred embodiment, housing 60 is of unitary construction. As used herein and throughout, the term "unitary" is meant to include either a one-piece structure or two or more back-to-back structures which are suitably secured to each other as by welding, bolts or other suitable fasteners. In one form, illustrated by way of example in FIG. 5, housing 60 defines an interior axial bore or elongated hollow chamber 68 having a generally cylindrical configuration in cross-section (FIG. 5) and which opens to the opposed open ends 64 and 66 of housing 60 (FIG. 4).

Each open end of housing 60 is provided with a plurality (with only one being shown in FIG. 6) of equi-angularly spaced and longitudinally extended tapered inner angled friction surfaces 70. The tapered inner angled friction surfaces 70 at each open end of housing 60 converge toward the longitudinal axis 62 and toward a longitudinal middle of the housing 60. Preferably, each opening at opposed ends of housing 60 is provided with three equally spaced and longitudinally extended surfaces 70 but more two or more tapered inner surfaces could be provided without detracting or departing from the spirit and novel concept of this invention disclosure.

Figure 4:
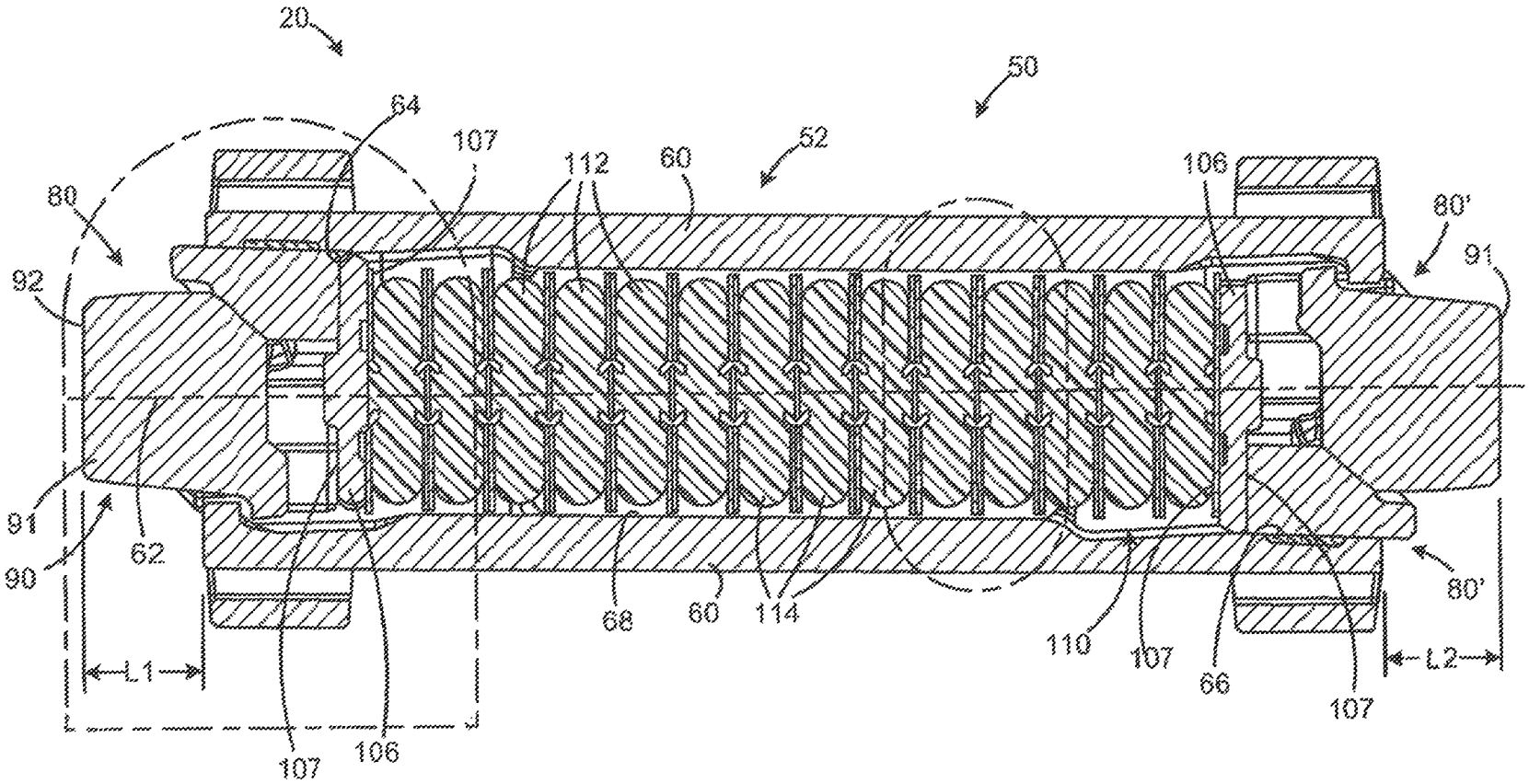
FIG. 4 is an enlarged cross-sectional view of one form of draft gear assembly forming part of the railcar coupling system of the present invention disclosure.

Returning to the embodiment illustrated in FIG. 4, the draft gear assembly 52 of the cushioning or energy absorption system 50 further includes a first friction clutch assembly 80 and a second friction clutch assembly 80' arranged in axially aligned relation relative to each other and in operable combination with the open ends 64 and 66, respectively, of housing 60. During operation of railcar 10 (FIG. 1), each clutch assembly 80, 80' serves to individually absorb axial forces or impacts directed against the cushioning or energy absorption system 50.

In one form, the first friction clutch assembly 80 and second friction clutch assembly 80' of draft gear assembly 52 are substantially identical in construction and operation relative to each other. Accordingly, only friction clutch mechanism 80 will be discussed in detail. Returning to FIG. 6, each friction clutch mechanism includes a plurality of friction members or shoes 82 equally arranged about axis 62 and in operable combination with the respective open end of housing 60.

Figure 6:
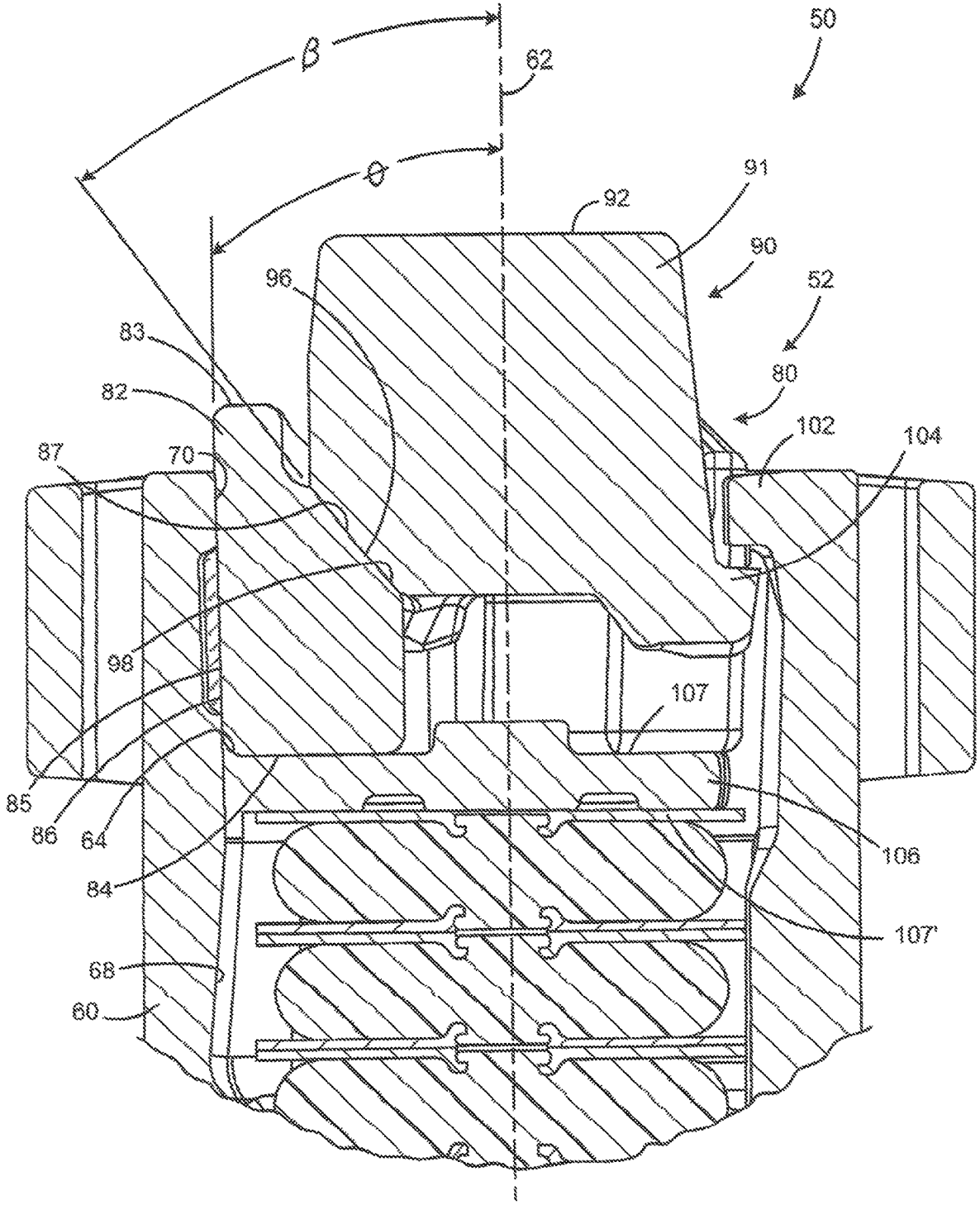
FIG. 6 is an enlarged view of the area encircled in phantom lines FIG. 4.
Figure 7:
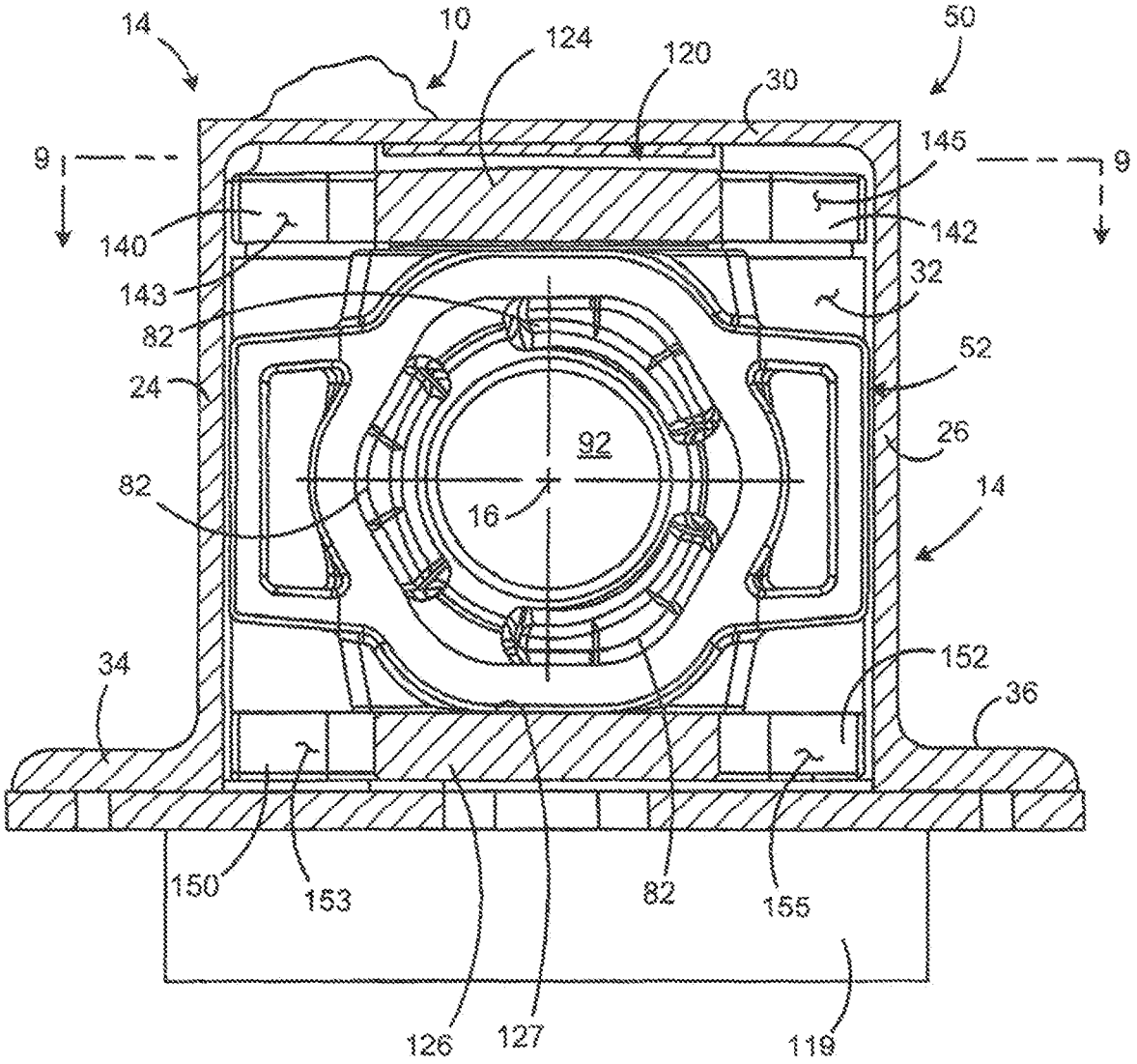
FIG. 7 is a cross-sectional view taken along line 7-7 of FIG. 3.

As shown by way of example in FIG. 7, each friction clutch assembly is preferably provided with three equi-angularly spaced friction members 82 but two or more friction members could be provided without detracting or departing from the spirit and scope of this invention disclosure. Suffice it to say, in the embodiment shown by way of example in FIGS. 6 and 7, the number of friction members 82 forming each friction clutch assembly are equal in number to the number of tapered inner angled friction surfaces 70 on housing 60.

In a preferred embodiment, the friction members or shoes 82 of each clutch assembly are substantially identical to each other. In the embodiment illustrated in FIG. 6, the friction members or shoes 82 of each friction clutch assembly have axially or longitudinally spaced first and second ends 83 and 84, respectively. Moreover, the friction members or shoes 82 each have an outer or external tapered sliding surface 85. When the draft gear assembly 52 is assembled, each inner angled friction surface 70 provided at each open end of housing 60 cooperates and combines with the complimentary outer external tapered sliding surface 85 on a confronting friction member or shoe to define a first angled friction sliding surface 86 therebetween. The first angled friction sliding surface 86 is disposed at an acute angle θ relative to the longitudinal axis 62 of the draft gear assembly 52.

In one form, the angle θ of the first angled friction sliding surface 86 ranges between about 1.5 degrees and about 5 degrees relative to the longitudinal axis 62 of the draft gear assembly 52. In a preferred embodiment, the angle θ of the first angled friction sliding surface 86 ranges between about 1.7 degrees and about 2 degrees relative to the longitudinal axis 62 of the draft gear assembly 52.

In the illustrated embodiment, each friction clutch assembly 80, 80' further includes a wedge or actuator 90 arranged for axial movements relative to the respective open end 80, 80' of housing 60. The wedge or actuator is formed from any suitable metallic material. As shown in FIGS. 4 and 6, an outer end 91 of each wedge 90 preferably has a generally flat face 92. When the cushioning assembly or energy absorption system 50 is in a neutral position or condition within the pocket 32 defined by the centersill 14 (FIGS. 2 and 3), the outer end 91 of the wedge 90 of each clutch assembly 80, 80' extends beyond the respective open end of housing 60 for an axial distance L1 (FIG. 4). In one design, the axial distance L1 preferably measures between about 3.25 inches and about 5.0 inches. Preferably, and when the cushioning assembly or energy absorption system 50 is in a neutral position or condition, the generally flat face 92 on the wedge or member 90 of each friction clutch assembly extends beyond the respective open end of housing 60 for an axial distance measuring about 4.5 inches. Alternatively, and as will be readily appreciated by those skilled in the art, and as illustrated in FIG. 4, the axial distance L1 the outer end 91 of the wedge 90 of clutch assembly 80 may extend beyond the respective open end of housing 60 can be different from the axial distance L2 the outer end 91 of the wedge 90 of clutch assembly 80' may extend beyond the respective open end of housing 60 without detracting or departing from the novel spirit and scope of this invention disclosure.

As illustrated in FIGS. 2 and 3, the generally flat face 92 on the wedge 90 of friction clutch assembly 80 is adapted to press against a front follower 94 arranged toward one end of the draft gear assembly 52, while the generally flat face 92 on wedge 90 of the friction clutch assembly 80' is adapted to press against a rear follower 94' arranged toward an opposed end of the draft gear assembly 52 such that impact forces directed against each actuator 90 during operation of the energy absorption system 50 are equally applied to and absorbed at both ends of the cushioning or energy absorption system 50 during operation of railcar 10 (FIG. 1). As known, each wedge 90 is arranged in operable combination with the friction shoes 82 of each friction clutch assembly 80, 80'.

Figure 6A:
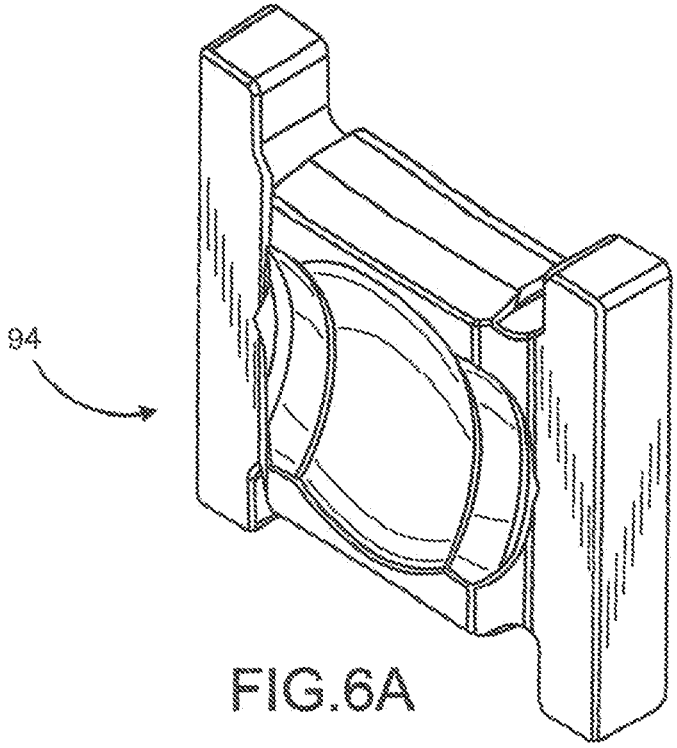
FIG. 6A is a perspective view of one form of front follower used in as part of the coupling system.
Figure 6B:
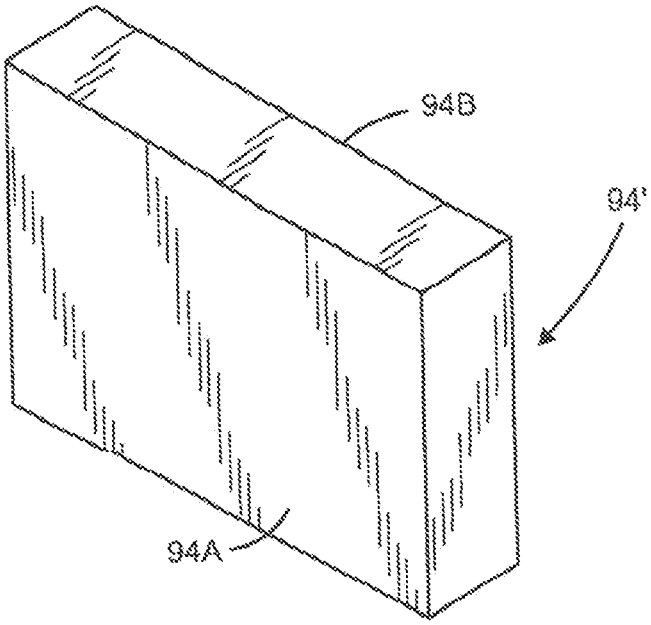
FIG. 6B is a perspective view of one form of rear follower used in as part of the coupling system.

In one embodiment of this invention disclosure illustrated in FIG. 6A, the follower 94 arranged toward a front end of the energy management system has a generally H-shaped configuration to better facilitate the distribution of impact forces directed against it. The numerous advantages which can be gained by this design are set forth in fuller detail in co-assigned U.S. Pat. No. 10,384,696; applicable portions of which are incorporated herein by reference. The follower 94' arranged toward an opposite end of the energy management system has a conventional design and, as illustrated by way of example in FIG. 6B, includes generally parallel faces 94A and 94B.

Returning to the embodiment illustrated by way of example in FIG. 6, the wedge or actuator 90 of each friction clutch assembly defines a plurality of equi-angularly spaced outer tapered or angled friction surfaces 96. Although only one angled friction sliding surface 96 is shown for illustrative purposes, the number of friction surfaces 96 on the wedge 90 equals the number of friction surfaces on members 82 forming part of each friction clutch assembly.

In the embodiment illustrated by way of example in FIG. 6, each outer angled friction surface 96 on wedge 90 combines with an inner angled friction sliding surface 87 on each friction member 82 of a respective clutch assembly to define a second angled friction sliding surface 98 therebetween. The second angled sliding surface 98 is disposed at an angle B relative to the longitudinal axis 62 of the draft gear assembly 52. In a preferred embodiment, the angle B of the second angled sliding friction surface 98 preferably ranges between about 32 degrees and about 45 degrees relative to the longitudinal axis 62 of the draft gear assembly 52.

In the embodiment illustrated by way of example in FIG. 6, each open end of the draft gear housing 60 is provided with a series of radially inwardly turned stop lugs 102 which are equi-angularly spaced circumferentially relative to each other. Toward a rear end thereof, wedge 90 includes a series of radially outwardly projecting lugs 104 which are equiangularly spaced disposed relative to each other and, during assembly, extend between adjacent friction members 82 (FIG. 7) so as to operably engage in back of the tugs 102 on housing 60 and facilitate assembly of the draft gear assembly.

In a preferred embodiment, each friction clutch assembly 80, 80' further includes a spring seat or follower 106 arranged within the hollow chamber 68 of housing 60 and disposed generally normal or generally perpendicular to the longitudinal axis 62 of the draft gear assembly 52. Spring seat 106 is adapted for reciprocatory longitudinal or axial movements within the chamber 68 of housing 60 and has a first surface 107 arranged in operable combination with the second or rear end of each friction member or shoe 82 of a respective clutch assembly. As shown in FIG. 6, the spring seat 106 also has a second or spring contacting surface 107'.

Returning to FIG. 4, an axially elongated elastomeric spring assembly 110 is disposed and slidable within the housing 60 of the draft gear assembly 52 between the first and second friction clutch assembly 80, 80'. The spring assembly 110 forms a resilient column for storing, dissipating and returning energy imparted or applied to the opposite ends of the draft gear assembly 52 during operation of the coupling system 20 (FIG. 2). The spring assembly 110 of each clutch assembly 80, 80' is adapted to press against a surface 107' on the spring seat 106 of each clutch assembly 80, 80'. The spring assembly 110 is precompressed during assembly of the draft gear assembly 52 and serves to: 1) maintain the components including the friction members 82 and wedge 90 of each friction clutch assembly 80, 80' in operable combination relative to each other both during operation of the draft gear assembly 52 as well as during periods of non-operation of the draft gear assembly 52; and, 2) maintain the free end of the wedge 90 of each friction clutch assembly 80, 80' in an extended position or condition wherein it presses against and moves the respective follower 94, 94' longitudinally outward; and, 3) maintain the followers 94, 94' pressed against the respective stops 23, 25 on the centersill 14.

In the embodiment of draft gear assembly 52 illustrated in FIG. 4, the spring assembly 110 is configured with a plurality of individual units or springs 112 arranged in axially stacked adjacent relationship relative to each other. In one form, the spring assembly 110 includes an axial stack of at least ten individual springs. Each individual spring 112 includes an elastomeric pad 114 which complements the interior of the hollow chamber 68 defined by housing 62 (FIG. 2) and has a generally torodial configuration.

Figure 8:
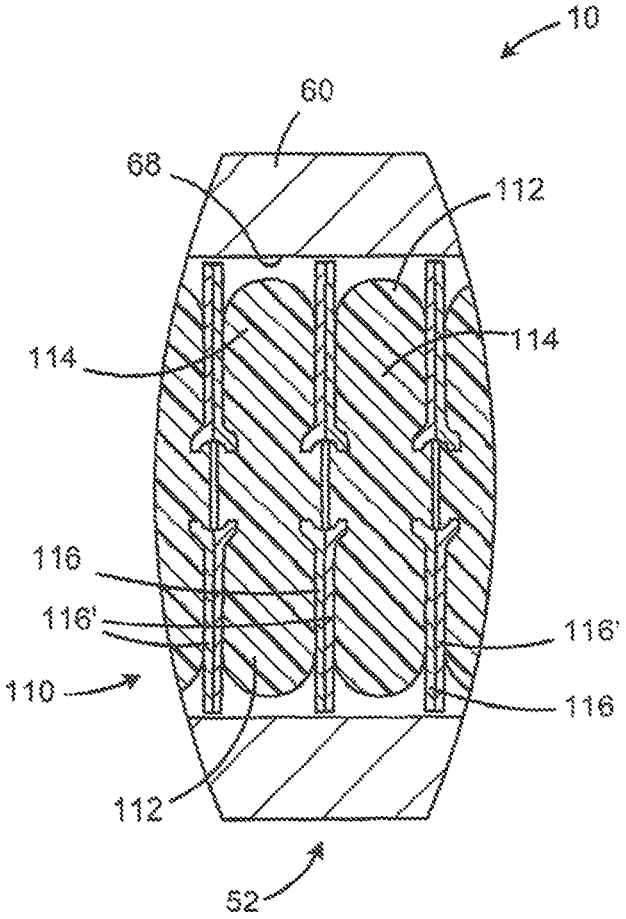
FIG. 8 is an enlarged sectional view of the area encircled in dash lines in FIG. 4.

Turning to FIG. 8, and in one embodiment, each pad 114 is preferably sandwiched between metal plates 116, 116' disposed at opposed sides of the pad 114. In one embodiment, the plates 116, 116' radially extend beyond the outer edge of the elastomer pad 114 captured therebetween to promote guidance of the spring assembly 110 within the housing 60. In yet another form, spring assembly 110 can be configured with a single metal plate disposed between two axially adjacent pads 114 without detracting or departing from the novel scope and spirit of this invention disclosure. In this form, the one metal plate between two or more axially adjacent pads of the spring assembly 110 which radially extend beyond the radial periphery of the pads would suffice to promote guidance of the spring assembly 110 within the housing 60. It will be appreciated, alternative methods and means, i.e. an axially elongated guide rod, can be utilized to promote guidance of the spring assembly 110 within the housing 60 without detracting or departing from the novel scope and spirit of this invention disclosure.

In one example, the elastomeric pad 114 is formed from a polyester material having a Shore D durometer hardness ranging between about 40 and about 60 and having an elastic strain to plastic ratio of about 1.5 to 1. The working process and methodology for creating each spring unit 112 involves creating preformed block which is precompressed for a percentage of the preformed height of the preform thereby transmuting the preform into an elastomeric spring. In this regard, attention is invited to U.S. Pat. No. 4,198,037 to D. G. Anderson; the entirety of which is incorporated herein by reference.

In an alternative embodiment of this invention disclosure, the durometer hardness of those elastomeric springs comprising spring assembly 110 may be different relative to each other. That is, the cumulative durometer hardness of the springs 112 disposed closet to the clutch assembly 80 can be different from the cumulative hardness of the springs 112 disposed closet to the clutch assembly 80'. Alternatively, the cumulative durometer hardness of the springs 112 disposed closet to the respective clutch assemblies 80, 80' can be different from the cumulative hardness of the springs 112 disposed closer to longitudinal center of the spring assembly 110. In another form, one or more of the elastomeric pads 114 forming spring assembly 110 can be formed as a composite structure of the type disclosed in U.S. Pat. No. 5,868,384 to D. G. Anderson; the entirety of which is incorporated herein by reference. Suffice it to say, each pad 114 can be formed from at least two layered elastomers each having different Shore D harnesses and different operating characteristics from the other. Such designs readily allow the functionality and performance characteristics of the cushioning assembly or energy absorption system 50 of the present invention disclosure to be "fine-tuned" to the particular environment wherein the cushioning assembly or energy absorption system 50 of the present invention disclosure is to be used and function.

Returning to FIG. 3, the energy management system 50 furthermore preferably includes a yoke 120 which is retained within the cavity or pocket 32 of each center sill structure and has a longitudinal axis. When disposed within cavity 32, the longitudinal axis of the draft gear assembly 52 and the longitudinal axis of yoke 120 are preferably arranged in generally aligned relationship with each other. In one form, the yoke 120 comprises an open-ended steel casting or it can be fabricated from separate steel components. In the embodiment illustrated by way of example in FIG. 3, yoke 120 is configured for use with a standard F coupler but it will be appreciated with slight redesign efforts, known to those skilled in the art, the teachings and principals of this invention disclosure equally apply to a yoke which is configured for use with a standard E coupler without detracting or departing from the novel spirit and broad scope of this invention disclosure. It will furthermore be appreciated by those skilled in the art, and without detracting or departing from the spirit and novel scope of this invention disclosure, the open end of the yoke 120 can be configured similar to yokes which are used in operable combination with hydraulic and/or standard draft gear applications.

As shown in FIG. 3, yoke 120 has a sideways inverted generally U-shaped configuration including a back wall 122, an axially elongated top wall 124 joined to and axially extending longitudinally from the back wall 122 toward a forward end of the cushioning assembly 50 and an elongated bottom wall 126 joined to and axially extending longitudinally from the back wall 122 toward that end of the cushioning assembly 50 disposed closet to the respective coupler 40. The walls 122, 124 and 126 of yoke 120 combine with each other to define a linearly unobstructed yoke pocket or chamber 127 extending from the back wall 122 to the open end thereof. As known, the top wall 124 and bottom wall 126 of yoke 120 extend generally parallel and to and are separated from each other to readily accommodate the cushioning or draft gear assembly 52 therebetween (FIG. 3).

Figure 5:
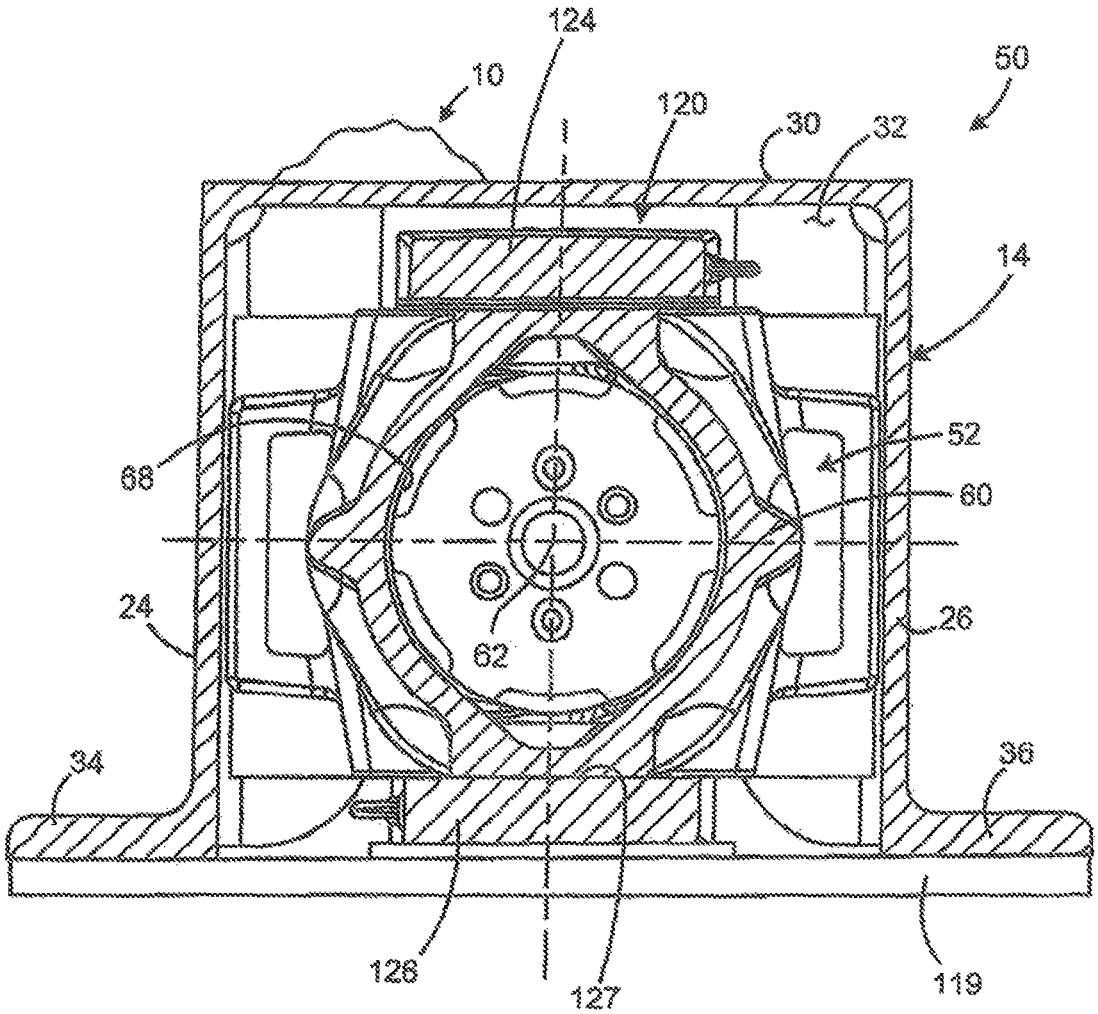
FIG. 5 is a sectional view taken along line 5-5 of FIG. 3.
Figure 9:
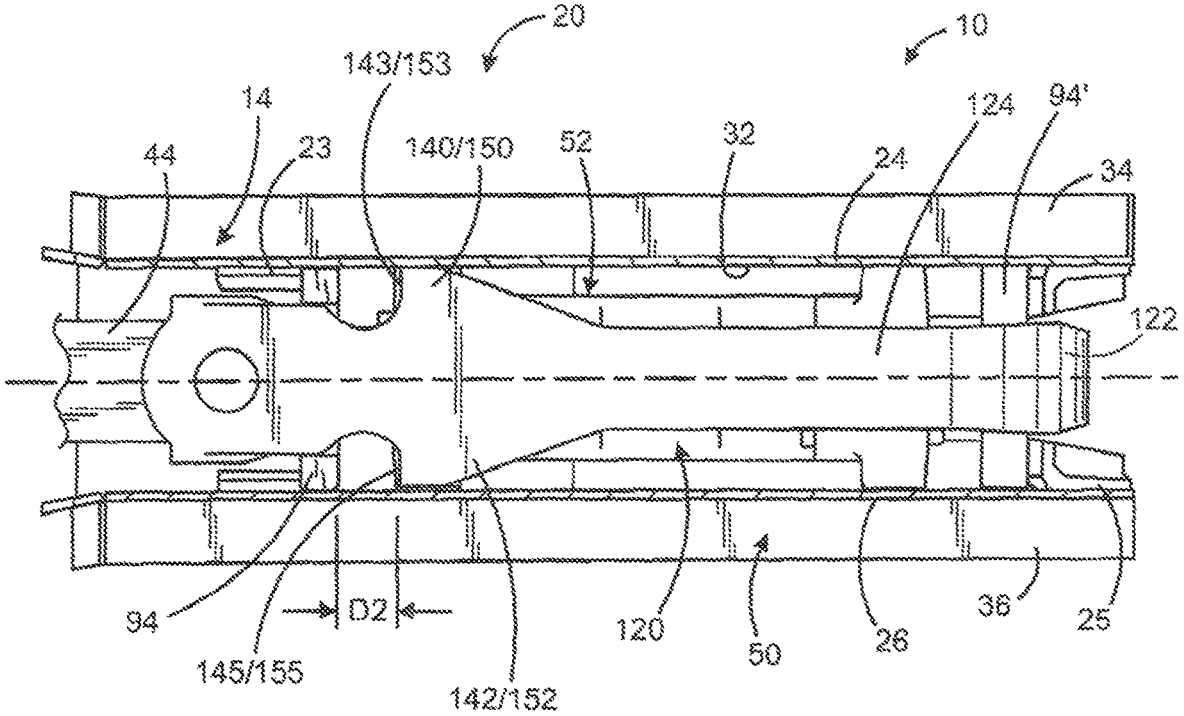
FIG. 9 is a view taken along line 9-9 of FIG. 7.

In the embodiment illustrated by way of example in FIGS. 5 and 7, the top and bottom walls 124 and 126, respectively, of yoke 120 embrace the draft gear assembly 52 therebetween and allow for endwise or longitudinal sliding movements of the draft gear assembly relative thereto. The yoke 120 is configured such that the back wall 122 thereof (FIG. 3) presses against and pushes the draft gear assembly 52 to the left as seen in FIGS. 2 and 3 during a draft operation of the coupling system 20. As illustrated in the embodiment shown in FIG. 9, the yoke 120 and particularly the lateral width of the back wall 122 thereof is configured to fit between the laterally spaced rear stops 25 on the centersill 14 whereby allowing substantially free or unhindered longitudinal translation of the yoke 120 during operation of the energy absorption system 50. Toward a forward open end thereof, and after other components of the draft assembly 50 are arranged in operable combination relative to each other, as discussed below, yoke 120 is operably coupled to the shank or butt portion 44 of coupler 40 as by a key or pin.

With the present invention disclosure, the draft gear assembly 52 of the energy management assembly 50 can be relatively easily installed in the pocket 32 of centersill 14 by using standard, well known installation procedures and into operable combination with the coupler 40. Returning to FIGS. 3, 5 and 7, after the cushioning or draft gear assembly 52 is in place in the centersill 14, standard support members 119 can be suitably attached to the flanges 34 and 36 on the centersill walls 24 and 26, respectively, to operably support the yoke 120 and draft gear assembly 52 within the pocket 32 and relative to the coupler 40.

Yoke 120 is preferably designed similar to that disclosed in further detail in coassigned U.S. Pat. No. 9,598,092; the full disclosure of which are incorporated herein by reference. In the embodiment illustrated in FIGS. 7 and 9, and along the length thereof, the top wall 124 of the yoke 120 has a pair of laterally spaced and laterally aligned stop members 140 and 142 which extend in opposed lateral directions from each other. Similarly, the bottom wall 126 of the yoke 120 (FIG. 7) also has a pair of laterally spaced and laterally aligned stop members 150 and 152 which extend in opposed lateral directions from each other. In a preferred form, the stop members 140, 142 are formed integrally with the top wall 124 of yoke 120 while the stop members 150, 152 are formed integrally with the bottom wall 126 of yoke 120. As shown in FIG. 7, the stop members 140, 142, 150 and 152 are arranged relative to each other to provide the yoke 120 with four co-planar stopping surfaces 143, 145 and 153, 155. Preferably, and as shown in FIG. 7, two stopping surfaces 143, 145 on the yoke 120 are disposed above the longitudinal axis 16 of car 10 while two stopping surfaces 153, 155 on the yoke 120 are disposed below the axis 16 of car 10. Moreover, two stopping surfaces 143 and 153 on the yoke 120 are preferably disposed to one lateral side of the longitudinal axis 16 of car 10 while two additional stopping surfaces 145 and 155 are disposed to an opposed lateral side of the axis 16 of car 10.

Returning to FIG. 9, and when the energy management system 50 of this invention disclosure is in a neutral position or condition, the co-planar inboard-facing stop surfaces 143, 145 and 153, 155 on the yoke 120 are disposed a predetermined distance D2 from the confronting surface on the front stop 23 on the sill 14 or the confronting surface on the follower 94. Alternatively, and with the present invention disclosure, when the energy management system 50 of this invention disclosure is in a neutral position or condition, the co-planar stop surfaces 143, 145 and 153, 155 on the yoke 120 can be disposed a predetermined distance from the confronting surface on the middle or center stops 27 (FIG. 2) on the draft sill 14.

During draft travel, the co-planar inboard-facing stop surfaces 143, 145 and 153, 155 on the yoke 120 will eventually and operably contact and engage with either the front stops 23 or middle stops 27 (FIG. 2) on the draft sill 14 or the confronting surfaces on the follower 94 thus preventing over travel of the draft gear assembly 50. Notably, and since they are formed as part of the yoke 120, the stop members 143, 145 and 153, 155 (FIG. 9) on the yoke 120 prevent potential separation of the coupler 40 from the draft gear sill 14 should a catastrophe occur regarding yoke 120. In the illustrated embodiment, and when the system 50 is in a neutral condition or position, the predetermined distance D2 the co-planar stop surfaces 143, 145 and 153, 155 on the yoke 120 are disposed from the confronting surface on the follower 94 is preferably less than the predetermined combined axial distance the free end of each wedge member 90 of each friction clutch assembly extends beyond the respective open end 64, 66 of the draft gear housing 60.

Figure 10:
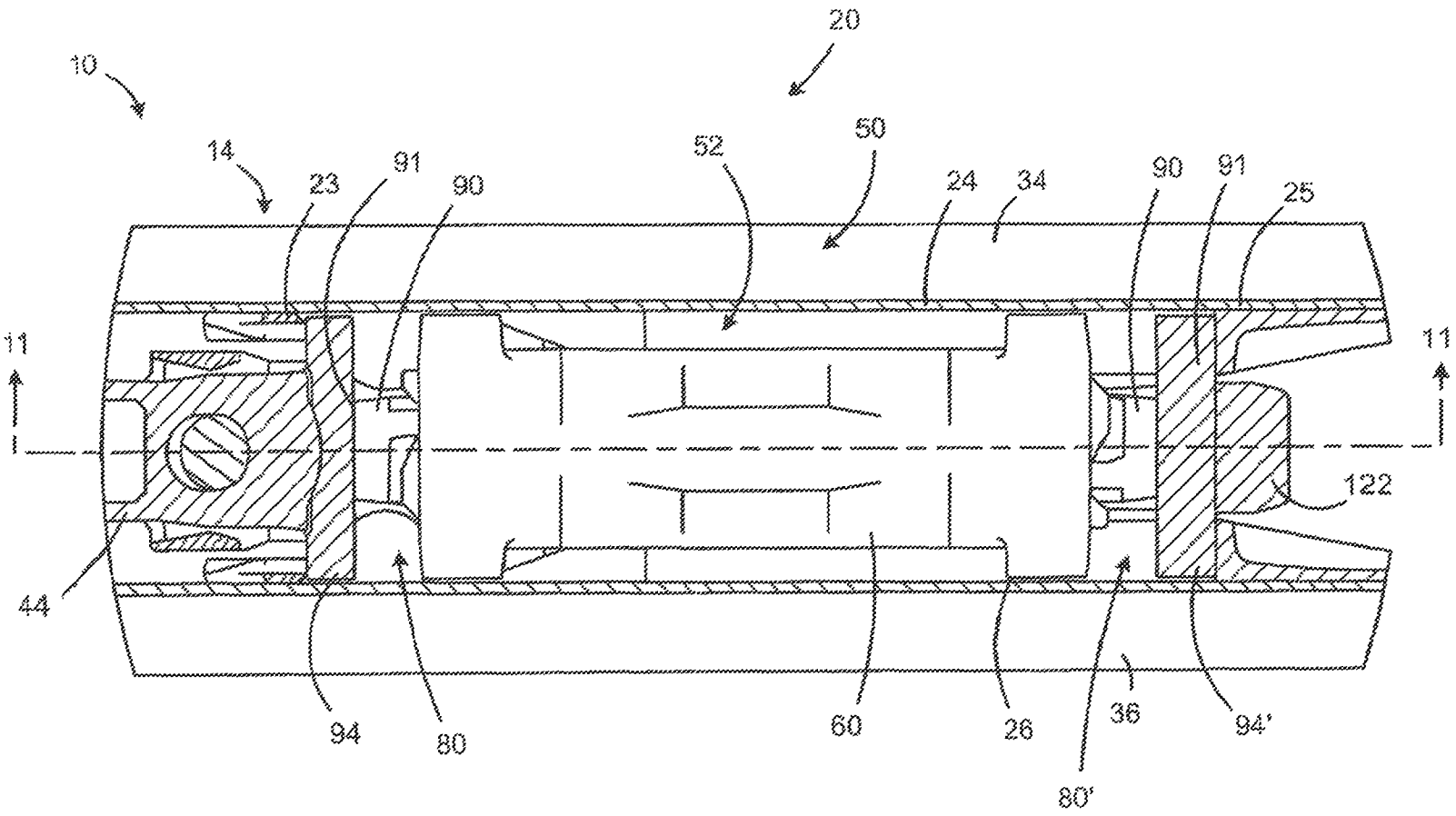
FIG. 10 is an enlarged fragmentary view similar to FIG. 2 showing the coupling system illustrated in a neural position or condition.
Figure 11:
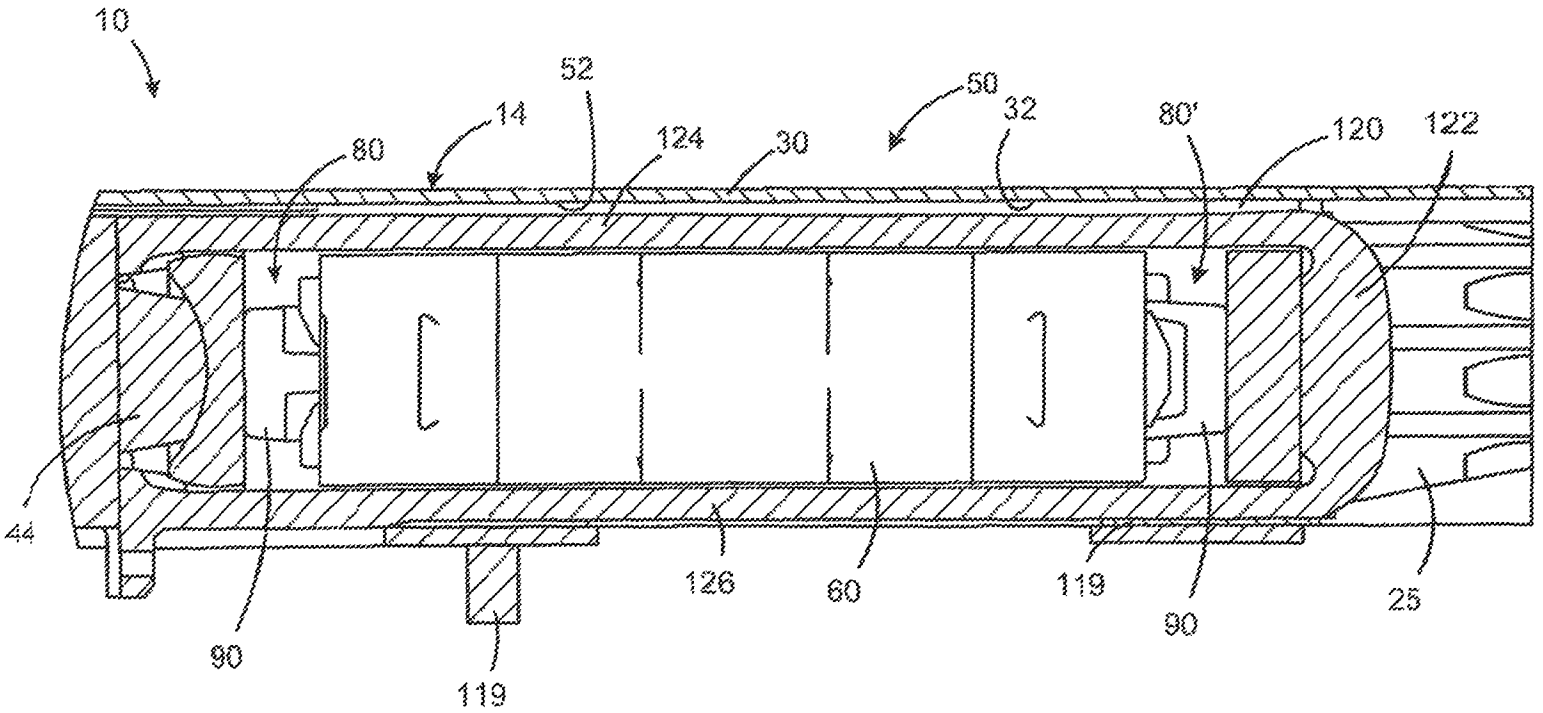
FIG. 11 is a fragmentary sectional side view of that portion of the coupling system taken along line 11-11 of FIG. 10.

FIGS. 10 and 11 show the energy management system 50 in a substantially neutral position. In such position, the free end 91 of the wedge 90 for each friction clutch assembly 80, 80' will preferably extend longitudinally beyond the respective open end of the draft gear housing 60. As the energy management system 50 moves toward a full draft position (shown in FIGS. 12 and 13), the yoke 120 is drawn to the left under the influence of the coupler 40 (FIG. 2). When the energy system is moving toward a full draft position or condition, the back wall 122 of the yoke 120 presses against and serves to compresses the overall length of the draft gear assembly 52.

Figure 12:
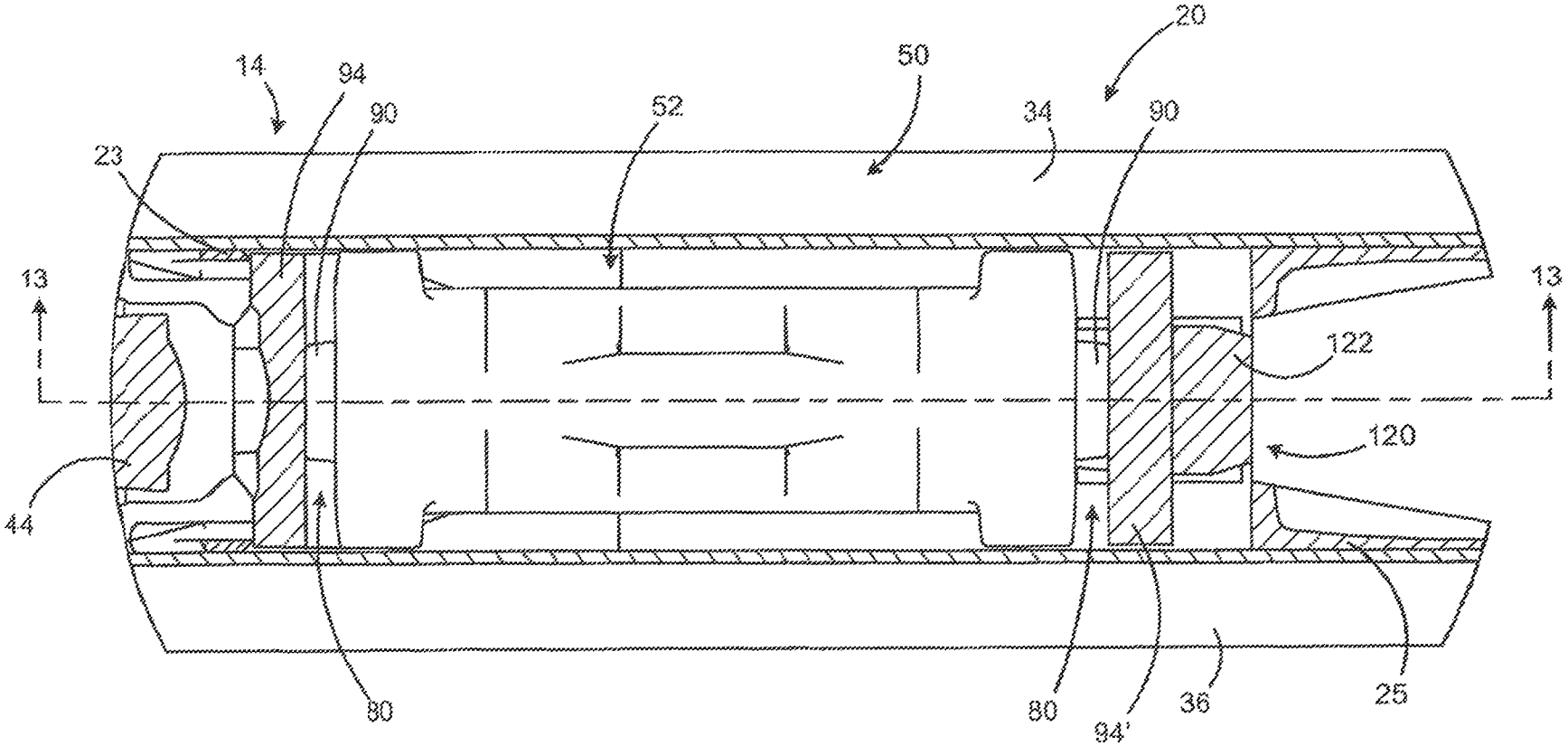
FIG. 12 is an enlarged fragmentary view similar to FIG. 2 showing the coupling system in a full draft position or condition.
Figure 13:
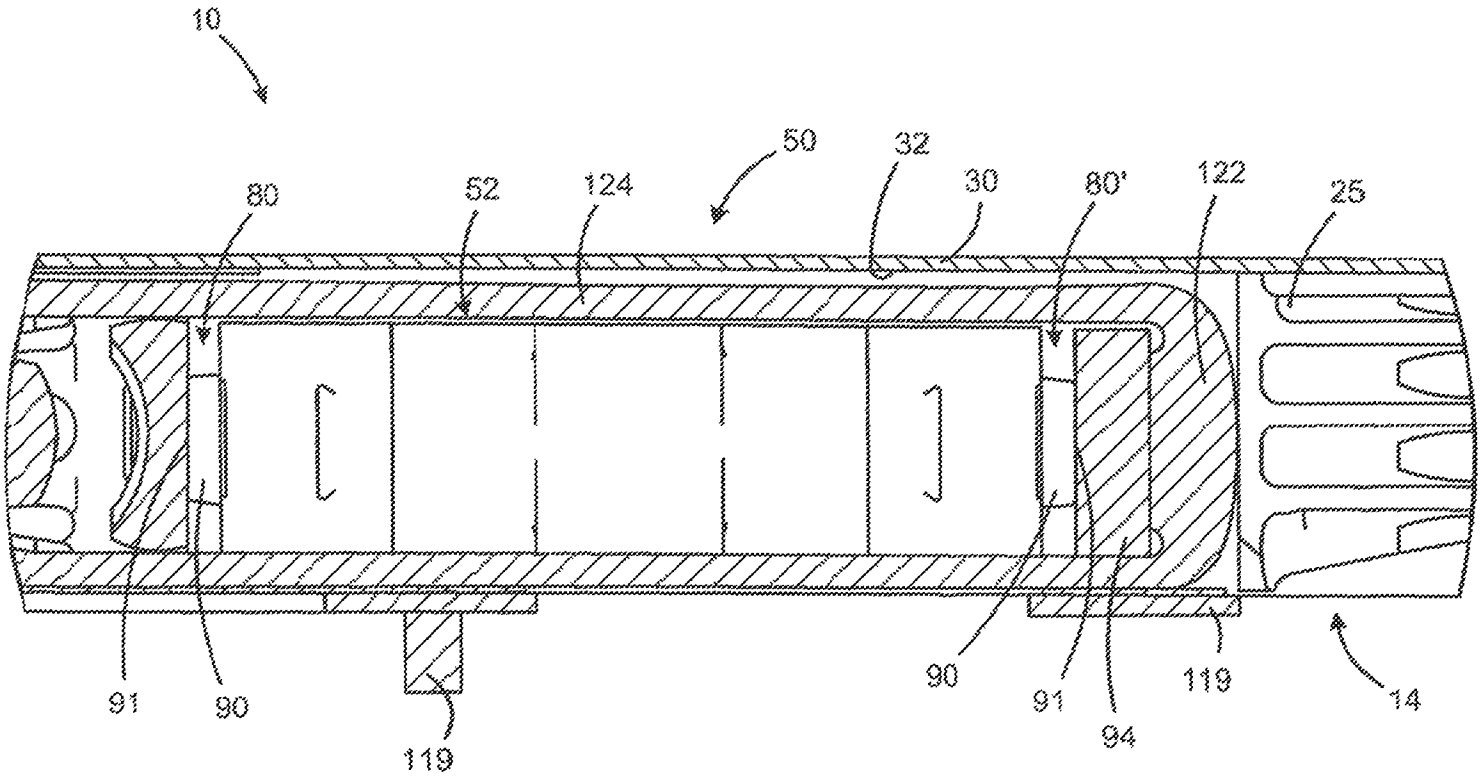
FIG. 13 is a fragmentary sectional view of the portion the coupling system taken along line 13-13 of FIG. 12.

In the full draft position shown by way of example in FIGS. 12 and 13, and when the stops 140, 142, 150 and 152 (FIG. 9) on yoke 120 operably engage with either the front stops 23 on the sill 14, or the front follower 94, or the middle stop 27 (depending upon which arrangement is selectively chosen) the wedge 90 of each friction clutch assembly 80, 80' axially collapses within the draft gear housing 60 against the action of the spring assembly 110 (FIG. 4). As such, there is at least partial travel of both friction clutch assemblies 80 and 80' along with the ten or more spring units 112 comprising the elongated spring assembly 110 (FIG. 4) which together serve to dissipate the draft forces acting on the energy absorption/coupling system 20.

Figure 14:
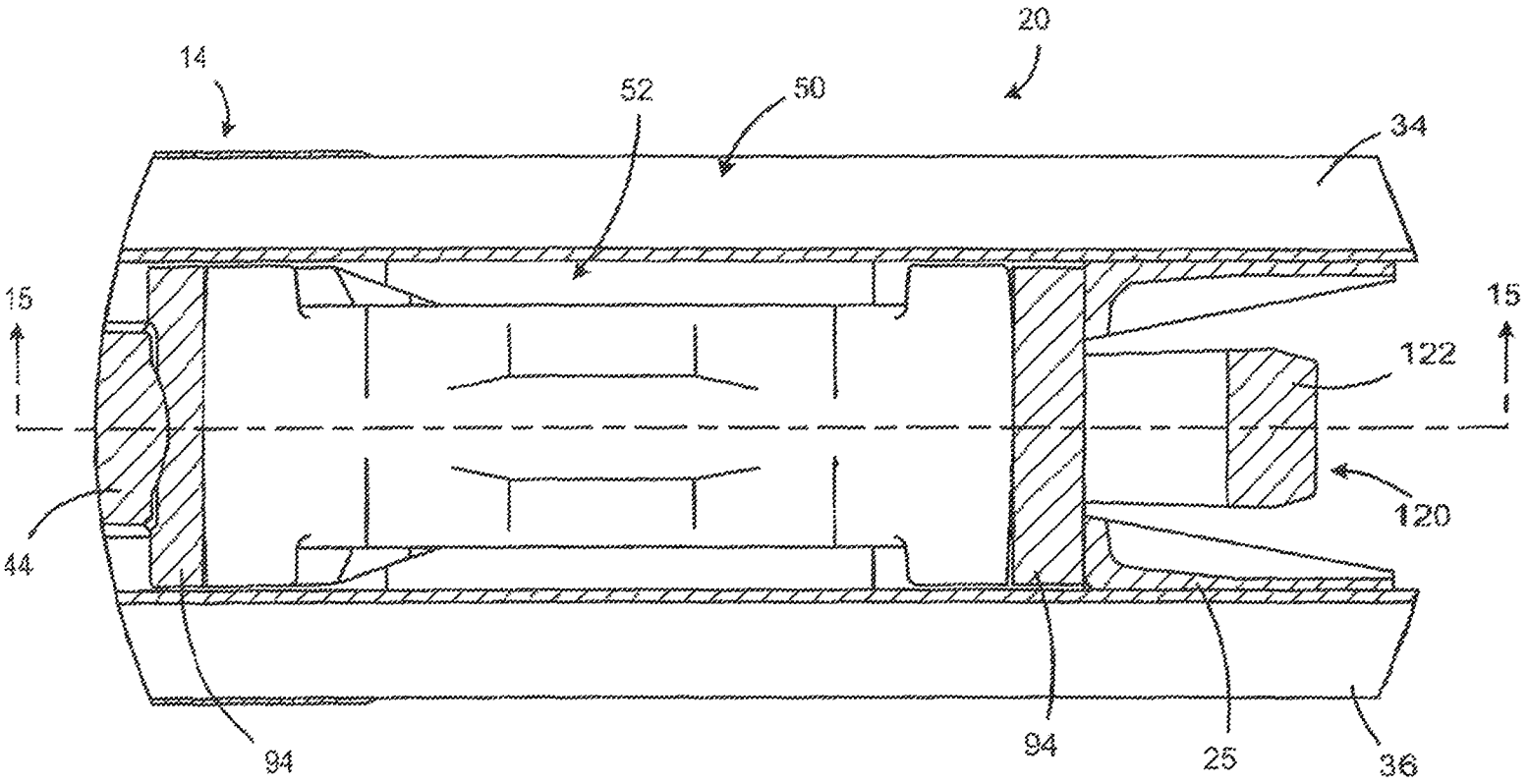
FIG. 14 is an enlarged fragmentary view similar to FIG. 2 showing the coupling system in a full buff position or condition.
Figure 15:
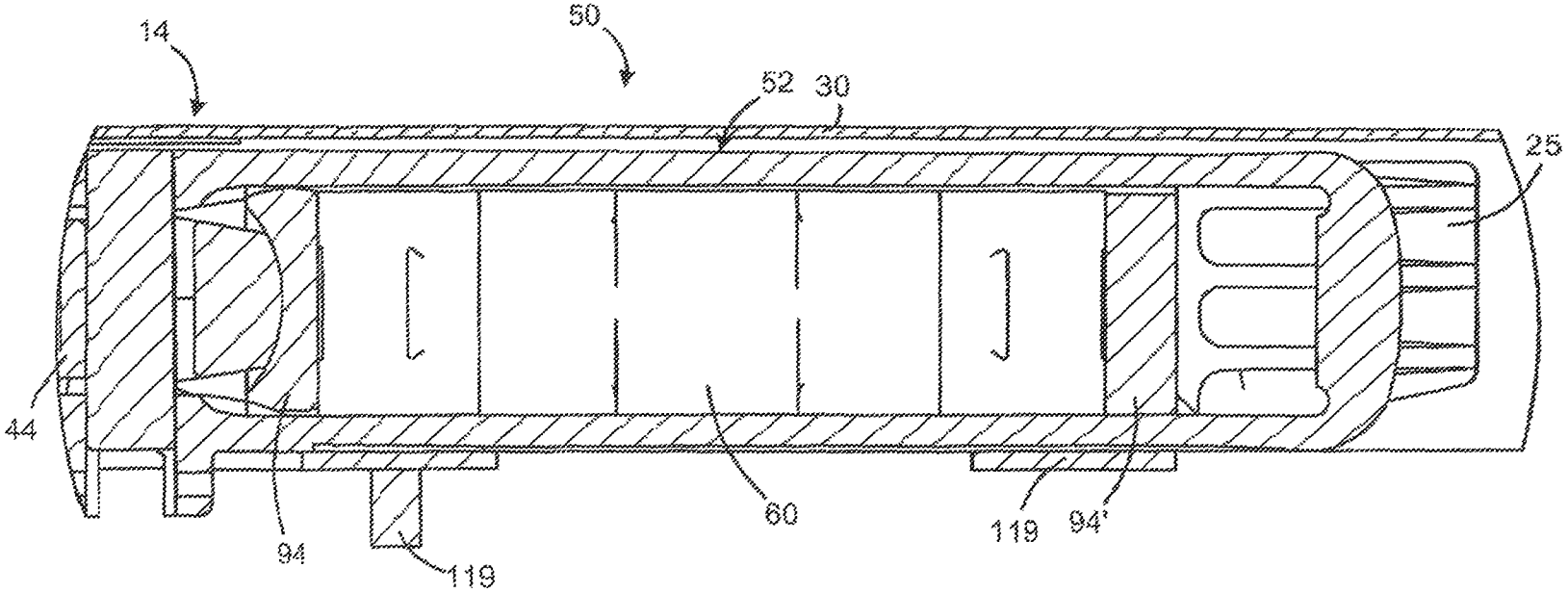
FIG. 15 is a fragmentary sectional view of that portion of the coupling system taken along line 15-15 of FIG. 14.

FIGS. 14 and 15 show the energy absorption/coupling system 20 in a full buff position. In the full buff position, and in the embodiment illustrated by way of example in FIGS. 14 and 15, the yoke 120 is pushed to the right by the shank 44 of coupler 40 as the cushioning assembly 50 continues movement to the right and until the draft gear assembly 52 is pushed into contact with the rear follower 94' to engage with the rear stops 25 on the centersill 14. As such, and upon engagement of the rear follower 94' with the rear stops 25, the operative length of cushioning assembly 50 is again axially compressed. Simultaneously, the front follower 94 is pushed to the right as seen in FIGS. 14 and 15 until it contacts with the draft gear housing 62. In full buff, both clutch assemblies 80, 80' (FIG. 4) are completely compressed.

In the illustrated embodiment, and when in a full buff position, the individual spring units 112 of spring assembly 110 (FIG. 4) of the draft gear assembly 52 are compressed by the wedge 90 of each clutch assembly 80, 80' as the wedge 90 axially collapses or retracts within the draft gear housing 62. As the system 20 moves from a neutral position or condition to the full buff position or condition, the actions of both clutch assemblies 80 and 80' (FIG. 4) along with the elongated spring assembly 110 (FIG. 4) all serve to dissipate the buff forces acting on the energy absorption/coupling system 20.

Figure 16:
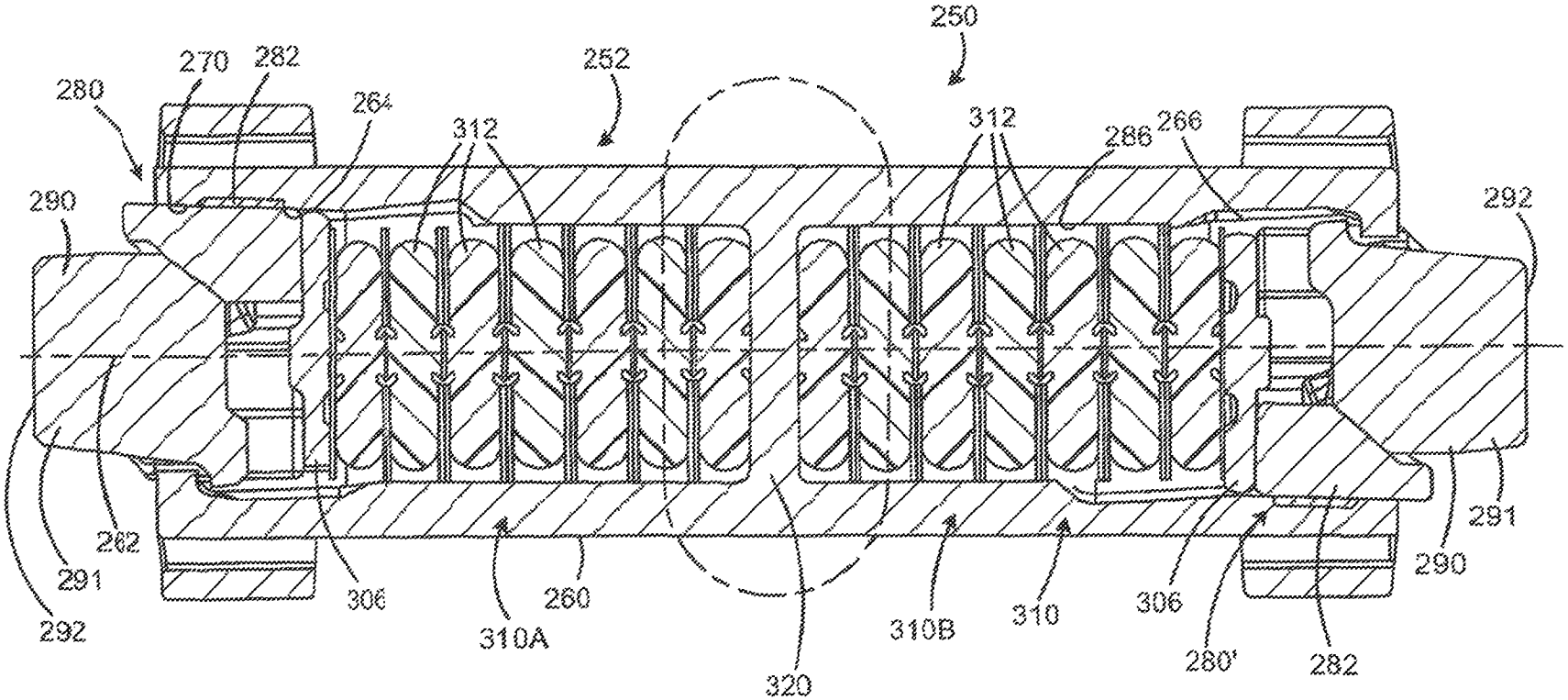
FIG. 16 is a view similar to FIG. 4 illustrating an alternative embodiment of a spring assembly for the draft gear assembly.

An alternative embodiment of a cushioning assembly or energy absorption system embodying principals and teachings of this invention disclosure and which includes a purely mechanical design having demonstrated the capability of heretofore known hydraulic dampeners with lesser concerns over maintenance is illustrated by way of example in FIG. 16. This alternative embodiment of cushioning assembly is designated generally by reference numeral 250. The elements of this alternative cushioning assembly or energy absorption system which are similar to those mentioned above regarding cushioning assembly or energy absorption system 50 are identified by like reference numerals in the 200 series and 300 series.

As with system 50, the essence of system 250 involves a unitary draft gear assembly 252 including two individually operable and axially spaced assemblies for absorbing both buff and draft forces normally encountered by railroad freight cars during their in-service operation. In this embodiment. the draft gear assembly 252 includes an axially elongated metallic and hollow housing 260 defining a longitudinal axis 262. Housing 260 defines a first open end 264 and a second open end 266 disposed in longitudinally spaced axial relation relative to each other. The unitary energy absorption system 250 is specifically configured and designed to fit within the pocket 36 (FIG. 4) defined by the centersill 14 on car 10. In a preferred embodiment, housing 260 is of unitary construction. In one form, illustrated in FIG. 16, housing 260 defines an interior axial bore or elongated hollow chamber 268 having a generally cylindrical configuration in cross-section and which opens to the opposed open ends 264 and 266 of housing 260.

In this alternative draft gear assembly embodiment, the axially spaced assemblies operably associated with the draft gear assembly 252 are each preferably designed as friction clutch assemblies. As such, each open end 264, 266 of housing 260 is provided with a plurality (with only one being shown in FIG. 16) of equi-angularly spaced and longitudinally extended tapered inner angled friction surfaces 270. The tapered inner angled friction surfaces 270 at each open end 264, 266 of housing 260 converge toward the longitudinal axis 262 and toward a longitudinal middle of the housing 260. Preferably, each opening 264, 266 of housing 260 is provided with three equally spaced and longitudinally extended surfaces 270 but two tapered inner surfaces could be provided without detracting or departing from the spirit and novel concept of this invention disclosure.

In this alternative embodiment of the draft gear assembly, the friction clutch assemblies are generally identified by reference numerals 280 and 280'. Suffice it to say, the friction clutch assemblies 280 and 280' of draft gear assembly 252 are substantially identical in construction and operation relative to each other and to the clutch assemblies 80, 80' discussed above. That is, each friction clutch mechanism 280, 280' includes a plurality of friction members or shoes 282 equally arranged about axis 262 and in operable combination with the respective open end 264, 266 of housing 260.

In the embodiment illustrated by way of example in FIG. 16, each friction clutch assembly 280, 280' further includes a wedge or actuator 290 arranged for axial movements relative to the respective open end of housing 260. The wedge or actuator is formed from any suitable metallic material. As shown, an outer end 291 of each wedge 290 preferably has a generally flat face 292. When the cushioning assembly or energy absorption system 250 is in a neutral position or condition within the pocket 32 defined by the centersill 14 (FIG. 2), the outer end 291 of the wedge 290 of each clutch assembly 280, 280' extends beyond the respective open end of housing 260 for an axial distance measuring between about 3.25 inches and about 5.0. Preferably, and when the cushioning assembly or energy absorption system 50 is in a neutral position or condition, the generally flat face 92 on the wedge 90 of each friction clutch assembly extends beyond the respective open end of housing 60 for an axial distance measuring about 4.5 inches. Alternatively, and as will be readily appreciated by those skilled in the art, the axial distance the outer end 291 of the wedge 290 of clutch assembly 280 may extend beyond the respective open end of housing 260 can be different from the axial distance the outer end 291 of wedge 290 of clutch assembly 280' may extend beyond the respective open end of housing 260 without detracting or departing from the novel spirit and scope of this invention disclosure. As will be understood by those skilled in the art, the generally flat face on the wedge 290 of each friction clutch assembly 280, 280' is adapted to press against a follower (not shown) arranged toward opposed ends of the draft gear assembly 252 such that impact forces directed against the actuator 290 are applied to both ends of the cushioning assembly or energy absorption system 250 during operation of railcar 10 (FIG. 1).

In a preferred embodiment, each friction clutch assembly 280, 280' further includes a spring seat or follower 306 arranged within the hollow chamber 268 of housing 260 and disposed generally normal or generally perpendicular to the longitudinal axis 262 of the draft gear assembly 252. Suffice it to say, spring seat 306 is substantially identical to and functions the same as the spring seat 106 described in detail above.

An axially elongated elastomeric spring assembly 310 is disposed and slidable within the housing 260 of the draft gear assembly 252 between the first and second friction clutch assembly 280, 280' and forms a resilient column for storing, dissipating and returning energy imparted or applied to the opposite ends of the draft gear assembly 252 during operation of the coupling system 20. The spring assembly 310 is precompressed during assembly of the draft gear assembly 252 and serves to: 1) maintain the components including the friction members and wedge of each friction clutch assembly 280, 280' in operable combination relative to each other both during operation of the draft gear assembly 252 as well as during periods of non-operation of the draft gear assembly 252; and, 2) maintain the free end of the wedge 290 of each friction clutch assembly 280, 280' pressed against the respective follower; and, 3) maintain each follower pressed against the respective stops 25 on the centersill 14.

As with spring assembly 110, in this embodiment of draft gear assembly 252, the spring assembly 310 is configured with a plurality of individual units or springs 312 arranged in axially stacked adjacent relationship relative to each other. In one form, the spring assembly 310 includes a plurality of individual springs arranged in an axial stack relative to each other. In a preferred embodiment, at least ten individual springs are arranged in stacked relationship relative to each other. Preferably, the individual springs 312 of spring assembly 310 are substantially similar to those spring units or springs discussed above regarding spring units 112.

Figure 17:
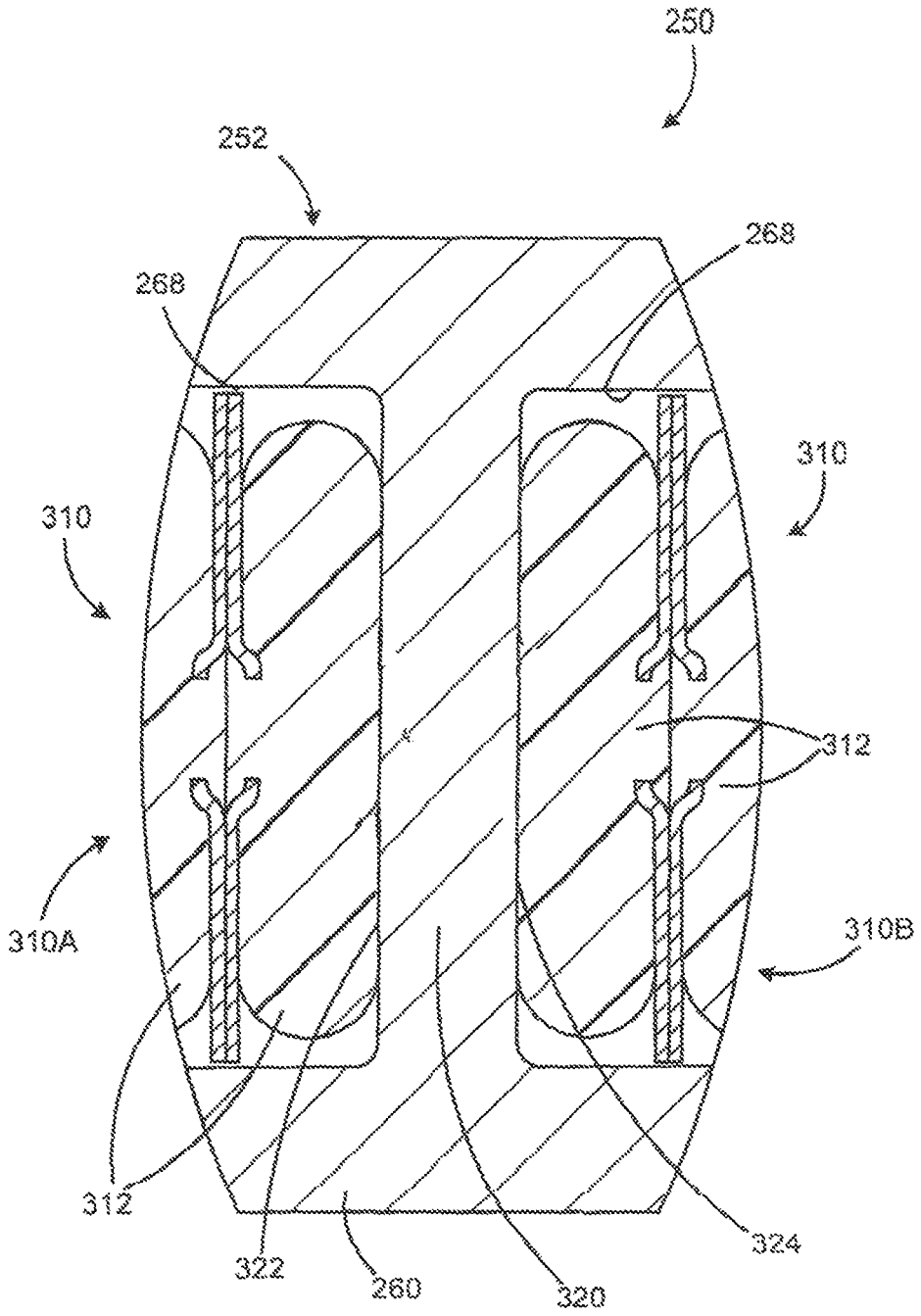
FIG. 17 is an is an enlarged view of the area encircled in phantom lines FIG. 16.

In the embodiment shown in FIGS. 16 and 17, a rigid separator 320 is disposed proximate mid-length of the spring assembly 310 and between two axially adjacent springs 312. During operation, the separator 320 operably divides the spring assembly 310 into two separate stacks of springs 310A and 310B which are axially aligned relative to each other. Preferably, the spring stacks 310A and 310B operate in series relative to each other.

Preferably, spring stack 310A is comprised of five or more spring units 312 and axially extends between separator 320 and the friction clutch 280 at the open end 264 of the draft gear assembly 252. Preferably, spring stack 310B is comprised of five or more spring units 312 and axially extends between separator plate 320 and the friction clutch 280 at the open end 266 of the draft gear assembly 352. The purpose of the separator plate 320 is to provide the spring assembly 310 with different spring rates or characteristics on opposite sides of the separator 320.

As shown in FIG. 17, the separator 320 has two generally planar and generally parallel spring engaging surfaces 322 and 324. In one form, a distance of about 0.375 inches to about 0.5 inches separates the spring engaging surfaces 322 and 324 on the separator 320. In one form, the separator 320 is suitably secured to the housing 260. In another form, the separator 320 is formed integral with the draft gear housing 260. In still another embodiment, the separator 320 is free to move longitudinally slide within the bore of the draft gear housing 260 in either one or both longitudinal directions.

Figure 18:
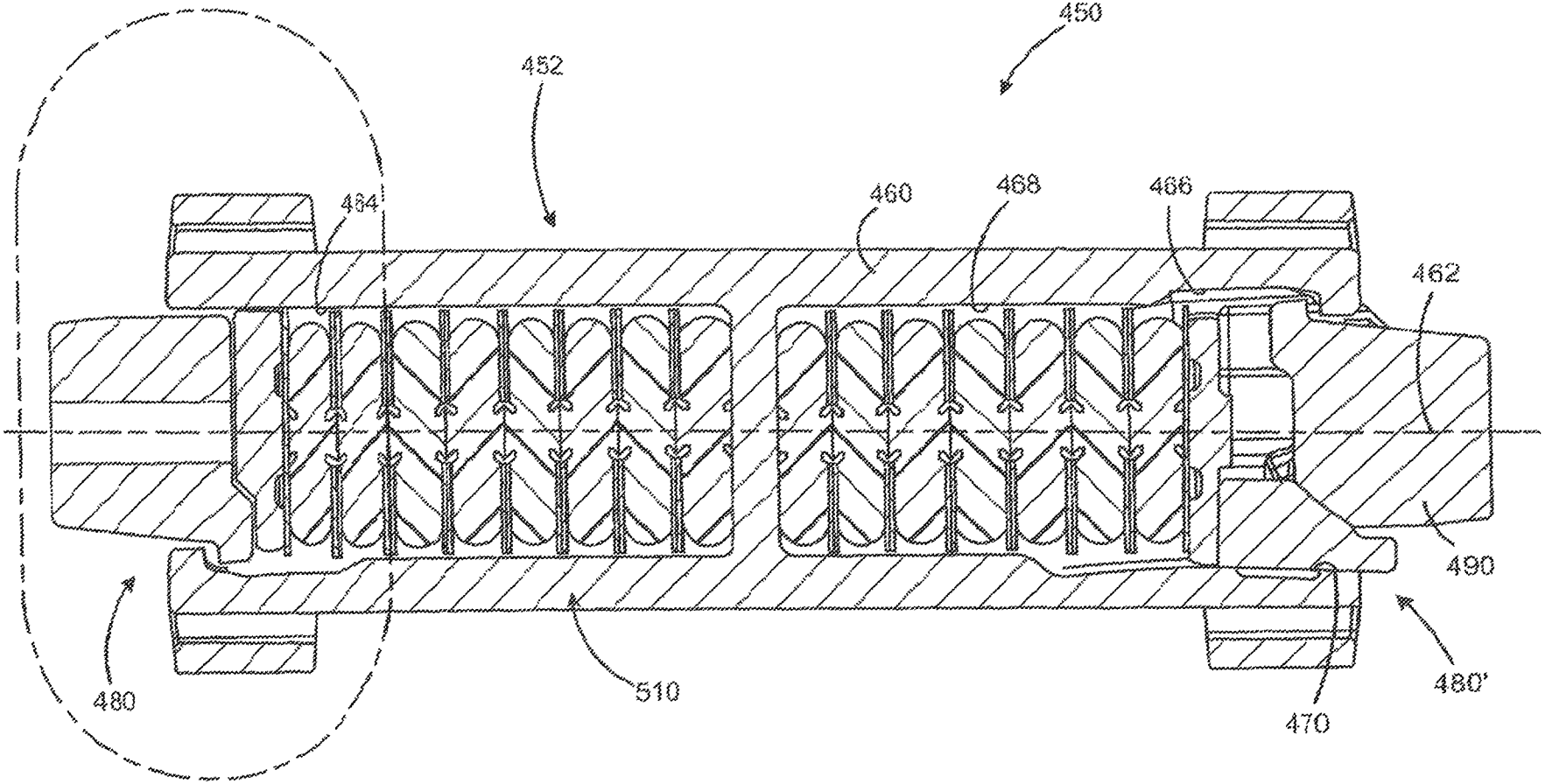
FIG. 18 is a cross-sectional view of an alternative form of draft gear assembly forming part of the railcar coupling system of the present invention disclosure.

Still another alternative embodiment of a cushioning assembly or energy absorption system embodying principals and teachings of this invention disclosure and which includes a purely mechanical design having demonstrated the capability of heretofore known hydraulic dampeners with lesser concerns over maintenance is illustrated by way of example in FIG. 18. This alternative embodiment of cushioning assembly is designated generally by reference numeral 450. The elements of this alternative cushioning assembly or energy absorption system which are similar to those mentioned above regarding cushioning assembly or energy absorption system 50 are identified by like reference numerals in the four hundred and five hundred series.

As with system 50, the essence of system 450 involves a draft gear assembly 452 having dual energy absorption capability. In this alternative embodiment of a cushioning assembly or energy absorption system illustrated by way of example in FIG. 18, the draft gear assembly 452 includes an axially elongated metallic and hollow housing 460 defining a longitudinal axis 462. Housing 460 defines a first open end 464 and a second open end 466 disposed in longitudinally spaced axial relation relative to each other. The cushioning assembly or energy absorption system 450 is specifically configured and designed to fit within the pocket 32 defined by the centersill 14 on car 10 (FIG. 2). In a preferred embodiment, housing 460 is preferably of unitary construction. In one form, illustrated in FIG. 18, housing 460 defines an interior axial bore or elongated hollow chamber 468 having a generally cylindrical configuration in cross-section and which opens to the opposed open ends 464 and 466 of housing 460.

Figure 19:
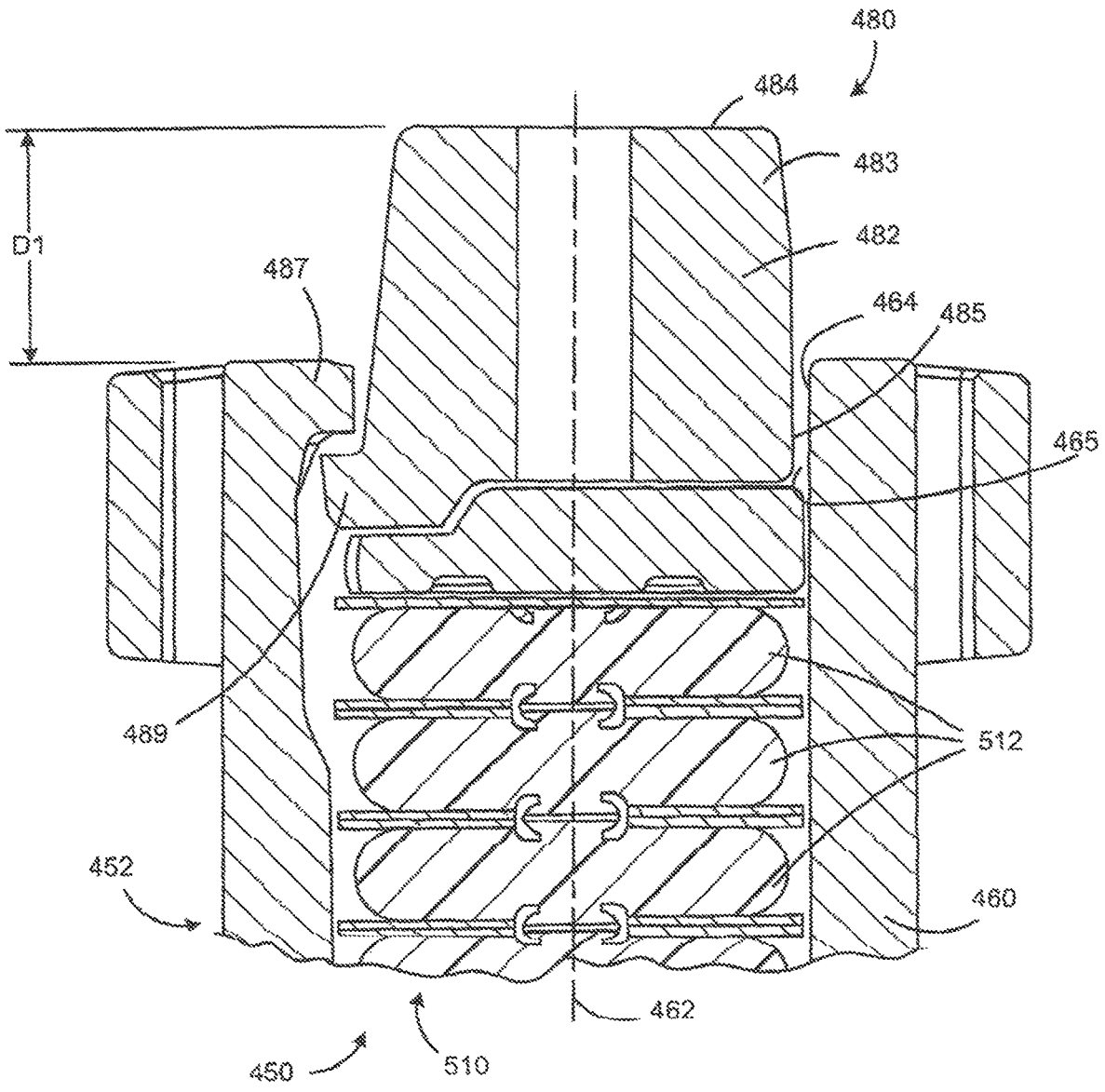
FIG. 19 is an enlarged view of the area encircled in phantom lines FIG. 18.

In the embodiment of a cushioning assembly or energy absorption system illustrated in FIGS. 18 and 19, the open end 464 of housing 460 has a generally cylindrical cross-sectional configuration whose inner diameter 465 (FIG. 19) generally parallels and is concentric with axis 462. The opposite open end 466 of housing 460 is preferably configured with a plurality (with only one being shown in FIG. 18) of equi-angularly spaced and longitudinally extended tapered inner angled friction surfaces 470. In one embodiment, the tapered inner angled friction surfaces 470 at the open end 466 of housing 460 is substantially similar to the inner angled surface 70 discussed above regarding housing 60. Preferably, each longitudinally extended tapered inner angled friction surface 470 on housing 460 converges toward the longitudinal axis 462 and toward a longitudinal middle of the housing 460.

In the embodiment illustrated in FIG. 18, the draft gear assembly 452 of cushioning or energy absorption system 450 further includes a first assembly 480 and a second assembly 480' arranged in operable combination with the open ends 464 and 466, respectively, of housing 460. In this alternative embodiment, the first assembly 480 includes a plunger 482 configured for axial reciprocatory movements within and relative to the open end 464 of housing 460.

As shown, an outer end 483 of plunger 482 preferably has a generally flat face 484 which presses against a railroad car follower disposed for axial movements within the open end 464 of housing 460. Preferably, and when the cushioning assembly or energy absorption system 450 is in a neutral position or condition within the pocket 32 defined by the centersill 14 (FIG. 2), the outer end 483 of the plunger 482 extends beyond the respective open end of housing 460 for an axial distance D1 measuring between about 2 inches and 5 inches such that the first assembly 480 absorbs some of the impact forces directed against the cushioning or energy absorption system 450 during operation of railcar 10 (FIG. 1).

In the embodiment illustrated by way of example in FIG. 19, and with those exceptions noted below, the plunger 482 of the first assembly 480 defines a generally cylindrical-like outer wall whose outer diameter 485 is generally equal to and guided for axial reciprocatory movements within and by the open end 464 of housing 460. In the embodiment illustrated by way of example in FIG. 19, the open end 464 of the draft gear housing 460 is provided with a series of radially inwardly turned stop lugs 487 which are equi-angularly spaced circumferentially relative to each other. Toward a rear end thereof, plunger 482 includes a series of lugs 489 which project outwardly from the outer wall of plunger 482 and are equi-angularly spaced or disposed relative to each other and extend between stop lugs 487.

Once the first assembly 480 is assembled relative to the draft gear assembly, the lugs 489 on the plunger 482 are disposed relative to the lugs 487 on the housing 460 to allow the plunger 482 to axially reciprocate relative to the housing 460 while inhibiting inadvertent separation of the plunger 482 relative to the housing 460 during operation of the draft gear assembly 450. As will be readily appreciated by those skilled in the art, any of several other designs, including a guide rod having cooperating instrumentalities for limiting the axial stroke or reciprocatory movements of the plunger 482, could equally be used to allow plunger 482 to axially reciprocate relative to the housing 460 while inhibiting inadvertent separation of the plunger 482 relative to the housing 460 during operation of the draft gear assembly 450 without detracting or departing from the spirit and scope of this invention disclosure.

In the embodiment illustrated in FIG. 18, the second assembly 480' of cushioning or energy absorption system 450 is arranged in operable combination with the open end 466 of housing 460. The second assembly 480' in this alternative form of draft gear assembly 452 is preferably in the form of a friction clutch assembly. Preferably, the friction clutch assembly arranged in operable combination with the open end 466 of the draft gear assembly 452 is substantially similar to that discussed above regarding clutch assembly 80'.

A spring assembly 510 is disposed and slidable within the housing 460 of the draft gear assembly 452 between the first assembly 480 and second assembly 480'. The spring assembly 510 forms a resilient column for storing, dissipating and returning energy imparted or applied to the opposite ends of the draft gear assembly 452 during operation of the coupling system 420. The spring assembly 510 is precompressed during assembly of the draft gear assembly 452 and serves to: I) maintain the components of the first assembly 480 and second assembly 480' in operable combination relative to each other during buff and draft operations of the draft gear assembly 452 as well as during periods of non-operation of the draft gear assembly 452; and, 2) maintain the free end of the plunger 482 of the first assembly 480 and the wedge 490 of the second assembly 480' pressed against the respective followers; and, 3) maintain the followers pressed against the respective stops 23, 25 on the centersill 14.

As with spring assembly 110 discussed above, in this embodiment of draft gear assembly 452, the spring assembly 510 is preferably configured with a plurality of individual units or springs 512 arranged in axially stacked adjacent relationship relative to each other. In one form, the spring assembly 510 includes an axial stack of individual springs. Preferably, at least ten individual springs are arranged in stacked relationship relative to each other. Each individual spring 512 of spring assembly 510 is substantially similar to that discussed above regarding spring 112.

In summary, the cushioning assembly or energy absorption system of the present invention disclosure includes a purely mechanical design having demonstrated the capability of heretofore known hydraulic dampeners with lesser concerns over maintenance. The essence of energy absorption system involves a draft gear assembly embodying two individually operable and axially spaced assemblies for absorbing both buff and draft forces normally encountered by railroad freight cars during their in-service operation From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A draft gear assembly for absorbing, storing and returning energy directed against a railcar with said draft gear assembly arranged in operable combination therewith, with said railcar having a centersill defining a pocket having a distance of about 38 inches to about 50 inches between front and rear stops, said draft gear assembly comprising:

an axially elongated and hollow metal housing having a first open end and a second open end disposed in longitudinally spaced relation relative to each other, with said housing being configured to fit within the pocket defined by the centersill on the railcar, with each end of said housing defining a series of longitudinally tapered and extended inner surfaces opening to and extending from each open end of said housing;

a first friction clutch assembly and a second friction clutch assembly arranged in operable combination with the respective open end of said housing, with each friction clutch assembly including a series of friction members equally spaced about a longitudinal axis of and extending toward a longitudinal center of said housing, with each friction member having axially spaced first and second ends and an outer surface extending between the ends, with the outer surface on each friction member being operably engaged and associated with one of the longitudinally tapered and extended inner surfaces on said housing so as to define a first angled friction sliding surface therebetween for each clutch assembly, with each friction clutch assembly also including a wedge operably held within an open end of said housing, with the wedge of each friction assembly being arranged for reciprocal movements relative to and having a free end extending beyond the respective open end of said housing and to which both buff and draft forces are applied during in-service operation of said railcar, with the wedge of each friction clutch assembly further defining a series of outer tapered surfaces equally spaced about the longitudinal axis of said housing, with each tapered outer surface on each wedge member being operably engaged and associated with an inner surface on each friction member so as to define a second angled friction sliding surface therebetween and such that the axial movements of the wedge of each clutch assembly inward relative to the respective open end of said housing causes the respective friction members to move longitudinally and radially outward, and with each friction clutch assembly further including a follower arranged within the housing, with one surface of the follower being arranged in operable engagement with the second end of each friction member of the respective clutch assembly;

an axially elongated spring assembly disposed and guided within the housing between the first and second friction clutch assemblies for storing, dissipating and returning energy imparted to the draft gear assembly, with the spring assembly including an axial stack of at least ten individual springs, with each spring including an elastomeric pad; and wherein the spring assembly is configured to function in operable combination with the disposition of said first and second angled sliding surfaces of each friction clutch assembly such that said draft gear assembly consistently and repeatedly absorbs energy over an entire range of travel of the wedge member of each friction clutch assembly in an inward axial direction relative to the housing.

2. The draft gear assembly according to claim 1, wherein the first and second angled friction sliding surfaces of said first and second clutch assemblies are substantially identical relative to each other.

3. The draft gear assembly according to claim 1, wherein the first angled friction sliding surface on the first clutch assembly is different from the first angled friction sliding surface on the second clutch assembly.

4. The draft gear assembly according to claim 1, wherein the second angled friction sliding surface on the first clutch assembly is different from the second angled friction sliding surface on the second clutch assembly.

5. The draft gear assembly according to claim 1, wherein each elastomeric pad of the multitude of springs comprising each spring assembly has a toroidal outer configuration.

6. The draft gear assembly according to claim 1, wherein each elastomeric pad of the multitude of springs comprising each spring assembly has a Shore D hardness ranging between about 40 and about 60.

7. The draft gear assembly according to claim 1, wherein each elastomeric pad of the multitude of springs comprising each spring assembly has a similar Shore D hardness.

8. The draft gear assembly according to claim 1, wherein some of the elastomeric pads of the multitude of springs comprising the spring assembly have a different Shore D hardness from other pads in the multitude of springs comprising the spring assembly.

9. The draft gear assembly according to claim 1, wherein a plurality of elastomeric pads of the multitude of springs comprising the elongated spring assembly disposed closest to the follower of the respective clutch assembly have a different elastomeric hardness as compared to those elastomeric pads of the multitude of springs comprising the elongated spring assembly which are disposed toward a middle of the elongated spring assembly.

10. The draft gear assembly according to claim 1, wherein said elongated and metal housing is of unitary construction.

11. A draft gear assembly adapted to be accommodated in a pocket defined by a railcar centersill, with said centersill having front and rear stops with a distance of about 38 inches to about 50 inches longitudinally separating said stops, said draft gear assembly comprising:

an axially elongated and hollow metal housing adapted to fit between said stops and defining first and second longitudinally spaced open ends, with each end of said housing defining a series of longitudinally tapered and extended inner surfaces opening to and extending from each open end of said housing;

a first friction clutch assembly arranged in operable combination with the first open end of said housing and a second friction clutch assembly arranged in operable combination with the second open end of said housing, with each friction clutch assembly including a series of friction members equally spaced about a longitudinal axis of and extending toward a longitudinal center of said housing, with each friction member having axially spaced first and second ends and an outer surface extending between the ends, with the outer surface on each friction member being operably engaged and associated with one of the longitudinally tapered and extended inner surfaces on said housing so as to define a first angled friction sliding surface therebetween for each clutch assembly, with each friction clutch assembly also including a wedge member arranged for axial movements relative to and having a free end extending beyond the respective open end of said housing and to which an external force is applied during operation of said railcar, with the wedge member of each friction clutch assembly defining a series of outer tapered surfaces equally spaced about the longitudinal axis of said housing, with each tapered outer surface on each wedge member being operably engaged and associated with an inner surface on each friction member so as to define a second angled friction sliding surface therebetween for each clutch assembly and such that the wedge member of each friction clutch assembly causes the respective friction members to move longitudinally and radially inward upon movement of the wedge member inwardly of the housing, and with each friction clutch assembly further including a follower arranged within the housing, with one surface of the follower being arranged in operable engagement with the second end of each friction member of the respective clutch assembly;

an elongated spring assembly disposed and guided within the housing between the first and second friction clutch assemblies for storing, dissipating and returning energy imparted to the draft gear assembly, with the spring assembly including an axial stack of at least ten individual springs, with each spring including an elastomeric pad; and wherein the spring assembly is configured to function in operable combination with the disposition of said first and second angled sliding surfaces of said first and second friction clutch assemblies such that said draft gear assembly consistently and repeatedly absorbs energy imparted to either end of the draft gear assembly over a combined range of travel of the wedge members of the friction clutch assemblies in an inward axial direction relative to the housing ranging between about 6.25 inches and about 9.5 inches.

12. The draft gear assembly according to claim 11, wherein the first and second angled friction sliding surfaces of said first and second clutch assemblies are substantially identical relative to each other.

13. The draft gear assembly according to claim 11, wherein the first angled friction sliding surface on the first clutch assembly is different from the first angled friction sliding surface on the second clutch assembly.

14. The draft gear assembly according to claim 11, wherein the second angled friction sliding surface on the first clutch assembly is different from the second angled friction sliding surface on the second clutch assembly.

15. The draft gear assembly according to claim 11, wherein each elastomeric pad of the multitude of springs comprising each spring assembly has a toroidal outer configuration.

16. The draft gear assembly according to claim 11, wherein each elastomeric pad of the multitude of springs comprising said spring assembly has a Shore D hardness ranging between about 40 and about 60.

17. The draft gear assembly according to claim 11, wherein each elastomeric pad of the multitude of springs comprising each spring assembly has a similar Shore D hardness.

18. The draft gear assembly according to claim 11, wherein a plurality of the elastomeric pads of the multitude of springs comprising the spring assembly have a different Shore D hardness from other pads in the multitude of springs comprising the spring assembly.

19. The draft gear assembly according to claim 11, wherein a plurality of elastomeric pads of the multitude of springs comprising the elongated spring assembly disposed closest to the follower of the respective clutch assembly have a different elastomeric hardness as compared to those elastomeric pads of the multitude of springs comprising the elongated spring assembly which are disposed toward a middle of the elongated spring assembly.

20. The draft gear assembly according to claim 11, wherein said elongated and metal housing is of unitary construction.

21. The draft gear assembly according to claim 11, wherein a rigid separator forms part of the spring assembly and is disposed between two adjacent individual springs of said spring assembly, with said separator having opposed sides.

22. The draft gear assembly according to claim 21, wherein a plurality of individual springs of said spring assembly, disposed to one side of said rigid separator, have a different spring rate compared to a spring rate of those individual springs of said spring assembly disposed to an opposite side of said rigid separator.

23. An energy absorption system for a rail car having a centersill defining a pocket having front and rear stops with a longitudinal distance of about 38 inches to about 50 inches longitudinally separating said stops, and a coupler having a head portion longitudinally extending beyond a free end of said centersill and a shank portion connected to and extending from said head portion, with said energy absorption system further including a draft gear assembly comprising:

an axially elongated and hollow metal housing defining first and second longitudinally spaced open ends with at least the first open end of said housing defining a series of longitudinally tapered and extended inner surfaces opening to and extending from the open end of said housing toward a longitudinal center of said housing;

a friction clutch assembly arranged in operable combination with the first open end of said housing with said friction clutch assembly including a series of friction members equally spaced about a longitudinal axis of and extending toward a longitudinal center of said housing with each friction member having axially spaced first and second ends and an outer surface extending between the ends, with the outer surface on each friction member being operably engaged and associated with one of the longitudinally tapered and extended inner surfaces on said housing so as to define a first angled friction sliding surface therebetween for said clutch assembly, with said friction clutch assembly also including a wedge member arranged for axial movements relative to and having a free end extending beyond the first open end of said housing and to which an external force is applied during operation of said railcar, with the wedge member of said friction clutch assembly defining a series of outer tapered surfaces equally spaced about the longitudinal axis of said housing, with each tapered outer surface on each wedge member being operably engaged and associated with an inner surface on each friction member so as to define a second angled friction sliding surface therebetween for said clutch assembly and such that the wedge member of said friction clutch assembly causes the respective friction members to move longitudinally and radially inward upon movement of the wedge member inwardly of the housing, and with said friction clutch assembly further including a follower arranged within the housing, with one surface of the follower being arranged in operable engagement with the second end of each friction member of the respective clutch assembly;

a member arranged for limited reciprocating axial movements within and relative to the second open end of said housing, with said member being biased outwardly of said housing by a spring assembly, and with said member having a free end extending beyond the second open end of said housing and to which an external force is applied during operation of said railcar;

with the spring assembly being disposed and guided within said housing between said friction clutch assembly and said member for storing, dissipating and returning energy imparted to the draft gear assembly, with the spring assembly including an axial stack of at least ten individual springs, with each spring including an elastomeric pad; and wherein said spring assembly being configured to function in operable combination with the disposition of said first and second angled sliding surfaces of said friction clutch assembly and said member such that said draft gear assembly consistently and repeatedly absorbs energy imparted to the draft gear assembly over a combined range of travel ranging between about 625 inches and about 9.5 inches.

24. The energy absorption system according to claim 23, further including a yoke having a back wall with top and bottom walls extending therefrom, with a shank portion of said coupler being operably connected toward a forward and open end of said yoke and with the back wall of said yoke operably engaging said draft assembly when said railcar is operated in draft.

* * * * *